US012540520B2

(12) United States Patent
Jones

(10) Patent No.: US 12,540,520 B2
(45) Date of Patent: Feb. 3, 2026

(54) SYSTEM FOR DISLODGING AND EXTRACTING TUBING FROM A WELLBORE

(71) Applicant: Tenax Energy Solutions, LLC, Clinton, OK (US)

(72) Inventor: Kevin Dewayne Jones, Clinton, OK (US)

(73) Assignee: Tenax Energy Systems, LLC, Clinton, OK (US)

( * ) Notice: Subject to any disclaimer, the term of this patent is extended or adjusted under 35 U.S.C. 154(b) by 0 days.

(21) Appl. No.: 18/804,557

(22) Filed: Aug. 14, 2024

(65) Prior Publication Data

US 2024/0401426 A1 Dec. 5, 2024

Related U.S. Application Data

(63) Continuation-in-part of application No. 18/321,064, filed on May 22, 2023, now Pat. No. 12,104,446, which is a continuation of application No. 17/509,176, filed on Oct. 25, 2021, now Pat. No. 11,655,684, which is a continuation of application No. 16/440,749, filed on Jun. 13, 2019, now Pat. No. 11,156,051.

(60) Provisional application No. 63/519,660, filed on Aug. 15, 2023, provisional application No. 62/796,369, filed on Jan. 24, 2019, provisional application No. 62/699,946, filed on Jul. 18, 2018.

(51) Int. Cl.

| | |
|---|---|
| ***E21B 29/02*** | (2006.01) |
| ***E21B 31/113*** | (2006.01) |
| ***E21B 33/12*** | (2006.01) |

(52) U.S. Cl.
CPC ..... *E21B 29/02* (2013.01); *E21B 31/113* (2013.01); *E21B 33/12* (2013.01)

(58) Field of Classification Search
CPC ..... E21B 29/02; E21B 31/113; E21B 31/16; E21B 33/12
See application file for complete search history.

(56) References Cited

U.S. PATENT DOCUMENTS 2,249,511 A 7/1941 Westall
3,913,668 A 10/1975 Heilhecker et al.
(Continued)

OTHER PUBLICATIONS

US 9,079,084, 8/2015, McDougall et al. (withdrawn)
(Continued)

*Primary Examiner* — Daniel P Stephenson
(74) *Attorney, Agent, or Firm* — Tomlinson McKinstry, P.C.

(57) ABSTRACT

A system used to dislodge and, if necessary, sever a tubular string that is stuck within a cased wellbore. The system utilizes a jar, a plurality of plugs, and a tubular severance device. Components of the system are carried to their respective desired downhole positions by downward fluid flow within the wellbore. The jar is configured to jar the string in an effort to dislodge the string from its stuck point. The plugs are configured to fill open perforations formed in the casing in order to direct the fluid toward the stuck point and away from the perforations. If the string cannot be freed by the jar, the tubular severance device is deployed within the string above the stuck point. Detonation of the device severs the string above the stuck point.

15 Claims, 22 Drawing Sheets

(56) References Cited

U.S. PATENT DOCUMENTS

| | | | | |
|---|---|---|---|---|
| 5,797,454 | A | 8/1998 | Hipp | |
| 6,497,290 | B1 | 12/2002 | Misselbrook et al. | |
| 7,513,305 | B2 | 4/2009 | Wilson | |
| 8,286,702 | B2 | 10/2012 | Umphries et al. | |
| 8,297,365 | B2 | 10/2012 | Dove | |
| 8,365,818 | B2 | 2/2013 | Schultz et al. | |
| 10,145,195 | B2 | 12/2018 | Craddock, Jr. et al. | |
| 10,209,047 | B2 | 2/2019 | Tallini et al. | |
| 10,544,655 | B2 | 1/2020 | Churchill | |
| 10,837,249 | B2 | 11/2020 | Watson et al. | |
| 11,156,051 | B2 | 10/2021 | Jones | |
| 11,655,684 | B2 * | 5/2023 | Jones | E21B 31/113 166/297 |
| 12,104,446 | B2 * | 10/2024 | Jones | E21B 31/113 |
| 2005/0072568 | A1 | 4/2005 | Robertson | |
| 2008/0041596 | A1 | 2/2008 | Blout et al. | |
| 2008/0073085 | A1 | 3/2008 | Lovell et al. | |
| 2009/0283322 | A1 | 11/2009 | Dove | |
| 2011/0061864 | A1 | 3/2011 | Umphries et al. | |
| 2011/0108276 | A1 | 5/2011 | Spence et al. | |
| 2012/0067578 | A1 | 3/2012 | Wood et al. | |
| 2014/0202708 | A1 | 7/2014 | Jacob et al. | |
| 2015/0226031 | A1 | 8/2015 | Hekelaar | |
| 2017/0247969 | A1 | 8/2017 | Jones | |
| 2017/0328160 | A1 | 11/2017 | Arnaly | |
| 2018/0163497 | A1 | 6/2018 | Younger | |
| 2018/0171745 | A1 | 6/2018 | Jones | |
| 2020/0024923 | A1 | 1/2020 | Jones | |
| 2022/0042388 | A1 | 2/2022 | Jones | |
| 2023/0287751 | A1 * | 9/2023 | Jones | E21B 29/02 |
| 2024/0401426 | A1 * | 12/2024 | Jones | E21B 29/02 |

OTHER PUBLICATIONS

International Search Authority "PCT International Search Report", Oct. 15, 2019, 4 pages, Korean Intellectual Property Office, Republic of Korea.

The devices shown in FIGS. 3-26 of U.S. Patent Appl. Publication No. 2017/0247969 authored by Jones were on-sale more than one year prior to Jun. 13, 2018.

The devices shown in FIGS. 2-8 of U.S. Patent Appl. Publication No. 2018/0171745 authored by Jones were on-sale more than one year prior to Jun. 13, 2018.

* cited by examiner

SYSTEM FOR DISLODGING AND EXTRACTING TUBING FROM A WELLBORE

SUMMARY

The present invention is directed to a system comprising a wellbore formed within the ground and having a casing installed therein. The system also comprises a tubular string having no opening between its ends and having a first portion situated within the casing and a second portion wound around an above-ground reel. The system further comprises a tool carrying an explosive charge and positioned within the second portion of the tubular string.

The present invention is also directed to a method of using a kit in an environment. The kit comprises a tool comprising an explosive charge, a funnel element, and at least one deformable ball. The funnel element has opposed first and second surfaces joined by a fluid passage. The funnel element also has an enlarged bowl that opens at the first surface and connects with a narrow neck that opens at the second surface. The at least one deformable ball is sized, in its undeformed state, to be seated within the bowl of the funnel element. The environment comprises a wellbore formed within the ground and having a casing installed therein, and a tubular string having a first portion situated within the casing and a second portion wound around an above-ground reel and terminating in an open end.

The method of using the kit in the environment first comprises the step of inserting the funnel element through an open end of the second portion of the tubular string. Thereafter, fluid pressure within the tubular string is increased until the funnel element is situated within the first portion of the tubular string. Thereafter, the at least one ball is positioned within the first portion of the tubular string. Thereafter, the tool is inserted through the open end of the second portion of the tubular string, and thereafter, fluid pressure is increased within the tubular string until the tool is situated within the first portion of the tubular string.

The present invention is also directed to a method of recovering at least a portion of a tubular string from a subterranean wellbore having a casing installed therein. The method first comprises the step of positioning a funnel element within the tubular string, the funnel element having a fluid passage extending therethrough. Thereafter, the fluid passage is blocked with the first deformable ball. Thereafter, fluid pressure within the tubular string is increased until the first deformable ball is expelled through the fluid passage in a downhole direction. Thereafter, the fluid passage is blocked with a second deformable ball, and thereafter, a tool comprising an explosive charge is positioned within an underground portion of the tubular string such that the tool is uphole from the funnel element.

The present invention is further directed to a method of using a tubular string installed within a subterranean wellbore and having an above-ground open end. The method comprises the step of inserting a tool carrying an explosive charge into the open end of the tubular string. The method further comprises the step of causing fluid flow within the tubular string to carry the tool to an underground position within the tubular string.

DETAILED DESCRIPTION

Figure 1:
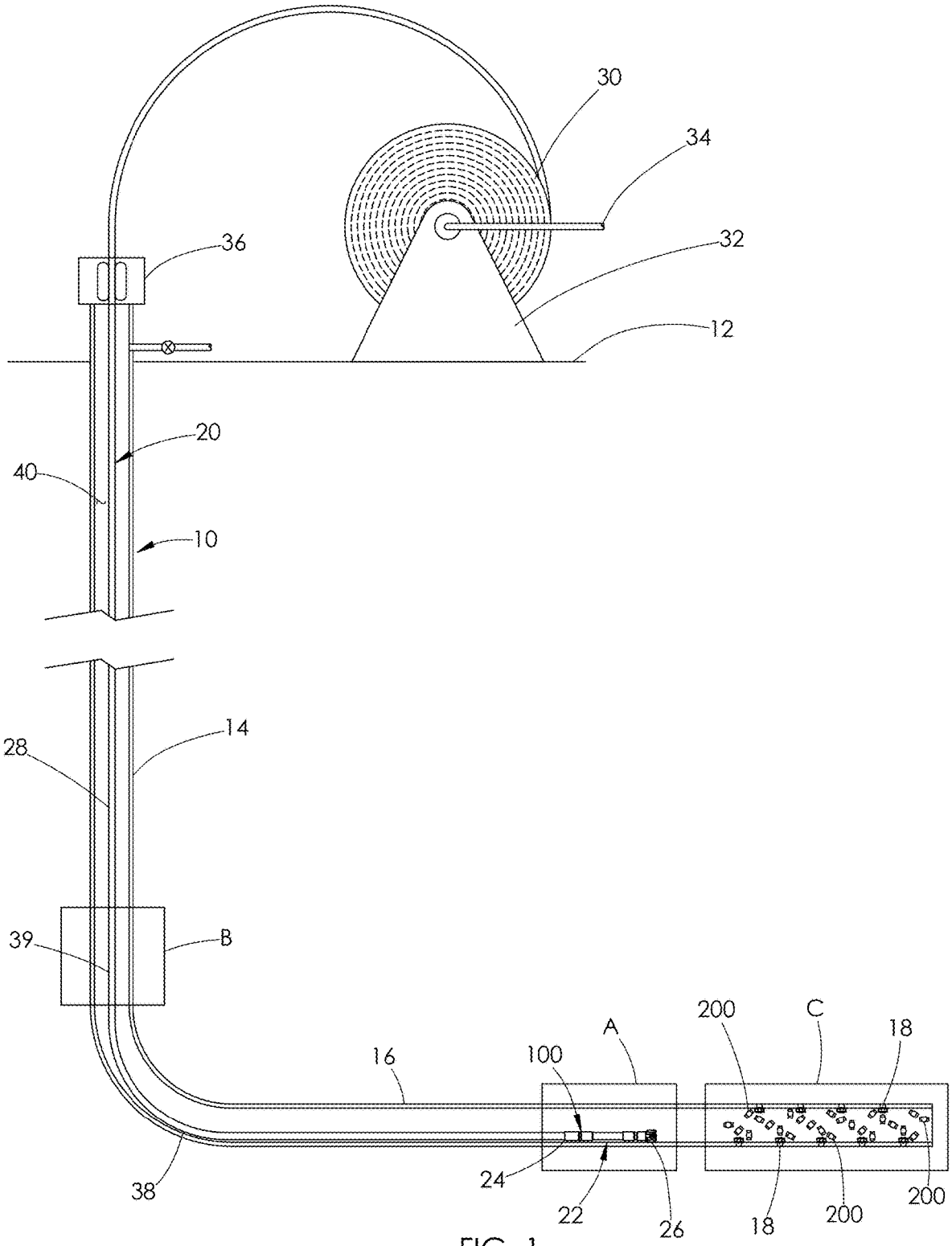
FIG. 1 is an illustration of a pipe recovery system used to dislodge or sever a tubular string that is stuck within a cased wellbore.

Turning to FIG. 1, during oil and gas drilling operations, a wellbore 10 is drilled beneath a ground surface 12 and a casing 14 is installed within the wellbore 10. The wellbore 10 may extend vertically and transition into a horizontal section 16. A plurality of perforations 18 may be formed in the walls of the casing 14 within the horizontal section 16.

The perforations 18 serve as an opening for oil and gas to flow from the surrounding subsurface and into the casing 14.

A tubular work string 20 is shown installed within the casing 14 in FIG. 1. The tubular string 20 is known in the art as "coiled tubing". Coiled tubing is typically used in well completion or workover operations to lower tools into the wellbore 10. The tools are typically included in a bottom hole assembly (BHA) 22 attached to a first end 24 of the string 20. The BHA 22 shown in FIG. 1, for example, includes a milling tool 26. Milling tools are used to grind up tools, such as large composite plugs, abandoned within the wellbore 10 during drilling and fracturing operations.

The tubular work string 20 is a long metal pipe that is typically between one and four inches in diameter. A first portion 28 of the string 20 is situated within the casing 14 and a second portion 30 is wound around an above-ground reel 32. A second end 34 of the string 20 is supported on the reel 32. No opening is formed within the string 20 between its opposed first and second ends 24 and 34.

In operation, the string 20 is unwound from the reel 32 and lowered into the casing 14 to the desired depth. An injector head 36 positioned at the ground surface 12 grips and thrusts the string 20 into the wellbore 10. As the string 20 advances through the wellbore 10, the string 20 or BHA 22 may become stuck. The string 20 or BHA 22 may become caught on well debris or lodged against the interior wall of the casing 14. For example, the string 20 is shown lodged against an interior wall of the casing 14 at a stuck point 38 in FIG. 1. The process of dislodging or recovering the stuck string 20 may be referred to as a pipe recovery operation.

Figure 2:
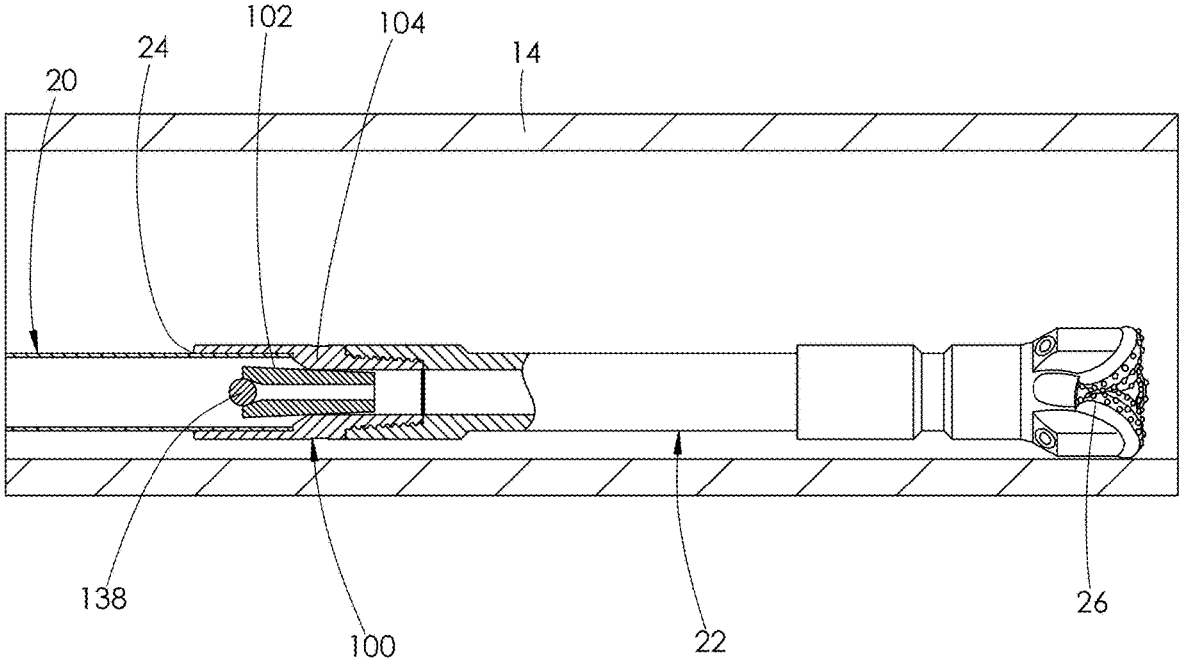
FIG. 2 is an enlarged view of area A shown in FIG. 1 and shows a jar. A deformable ball is seated within the funnel element of the jar. The ball and portions of the tubular string and bottom hole assembly are shown in cross-section.

One method of dislodging the string 20 from its stuck point 38 is to jar the string 20. One method of jarring the string 20 uses a jar 100 included in the BHA 22, as shown in FIG. 2.

Figure 4:
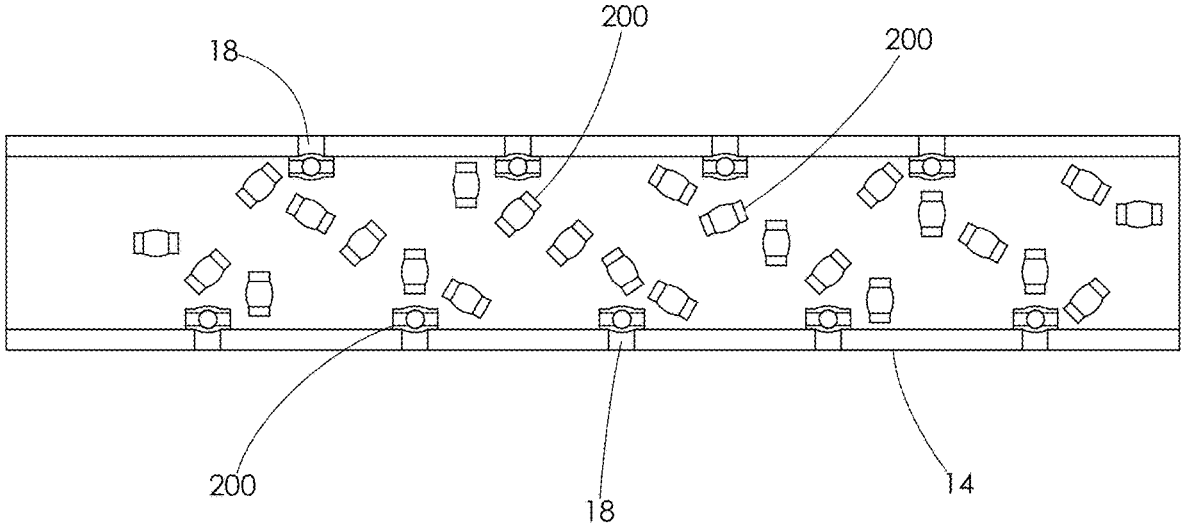
FIG. 4 is an enlarged view of area C from FIG. 1 showing a plurality of plugs seated against perforations formed within the casing. Some of the plugs are shown with the sleeve partially cut away, in order to reveal the plug's insert element.

If the string 20 is caught on debris at the stuck point 38, one method of dislodging the string 20 is to pump fluid into the annulus 40 between the casing 14 and the string 20. The fluid washes debris away from the stuck point 38. If the casing 14 has been perforated during an earlier fracturing operation, fluid may flow through those perforations 18, instead of flowing toward or around the stuck point 38. To prevent such diversion, a plurality of plugs 200 may be used to fill the perforations 18, as shown in FIG. 4.

Figure 5:
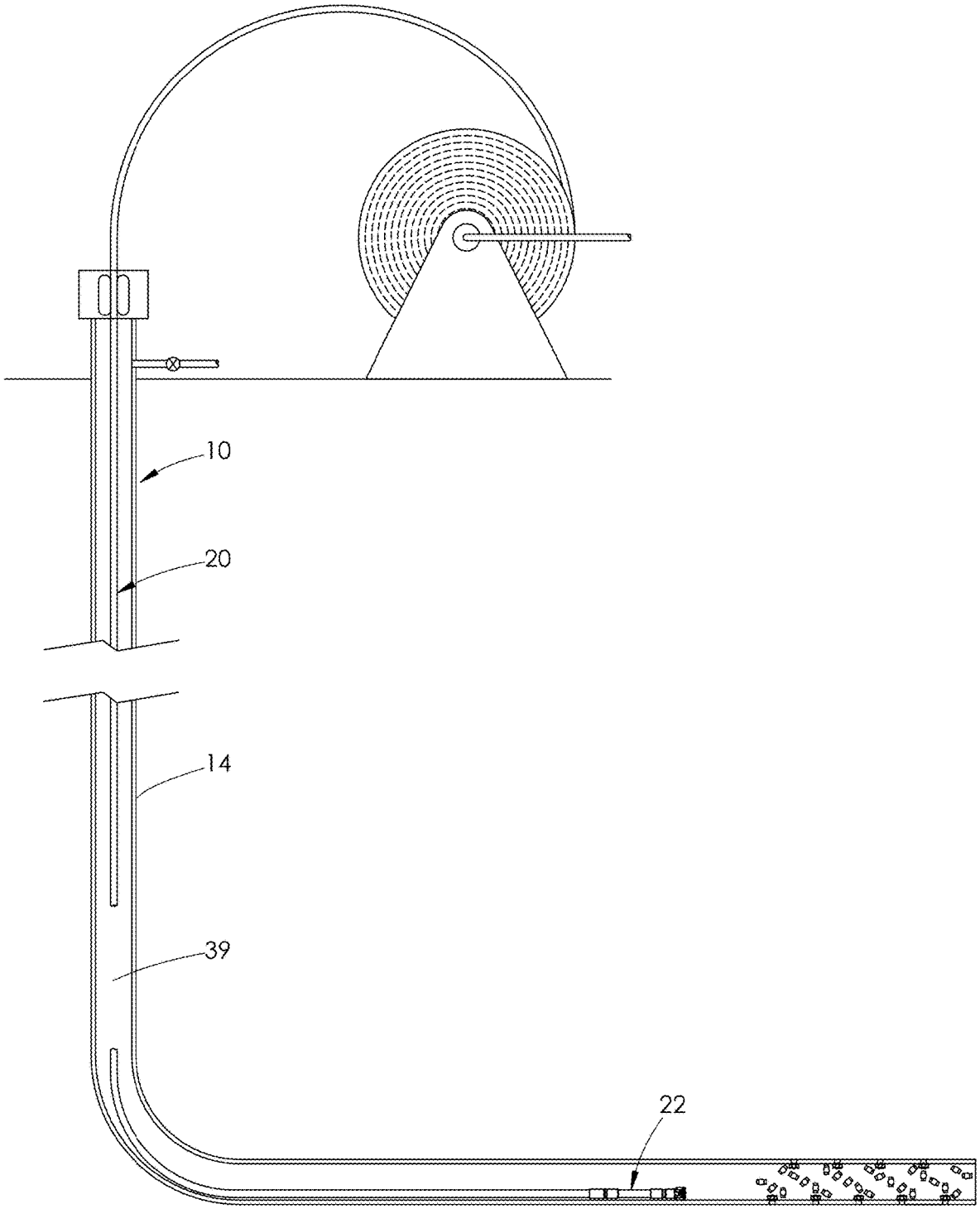
FIG. 5 shows the wellbore and pipe recovery system of FIG. 1, after the tubular string has been severed.

If the string 20 cannot be dislodged or freed from debris, it may be necessary to sever the string 20 above its stuck point 38. The string 20 may be severed using a tubular severance device 300, shown in FIG. 3. The portion of the string 20 above the point of severance 39 may be recovered from the wellbore 10 and salvaged, as shown in FIG. 5. The portion of the string 20 below the point of severance 39 may be fished out of the wellbore 10 or milled into small pieces. The milled pieces may be flushed from the wellbore 10 with fluid.

Tubular severance devices known in the art are typically lowered into a tubular work string on a wireline. In order to insert the wireline into the string, the string must first be cut near the injector head at the ground surface. The cutting operation produces an opening into which the wireline may be lowered. However, cutting the string at the injector head exposes the string to atmospheric pressure. Such exposure can cause pressure changes within the wellbore and resulting damage to the string. Such damage may impair the string's salvageability.

As will be discussed in more detail herein, the tubular severance device 300 may be lowered into the wellbore 10 without opening the tubular string 20 at the ground surface 12. The device 300 may be carried in fluid to the desired severance point. The device 300 works in combination with the jar 100 to position the device 300 at the desired severance point.

Figure 6:
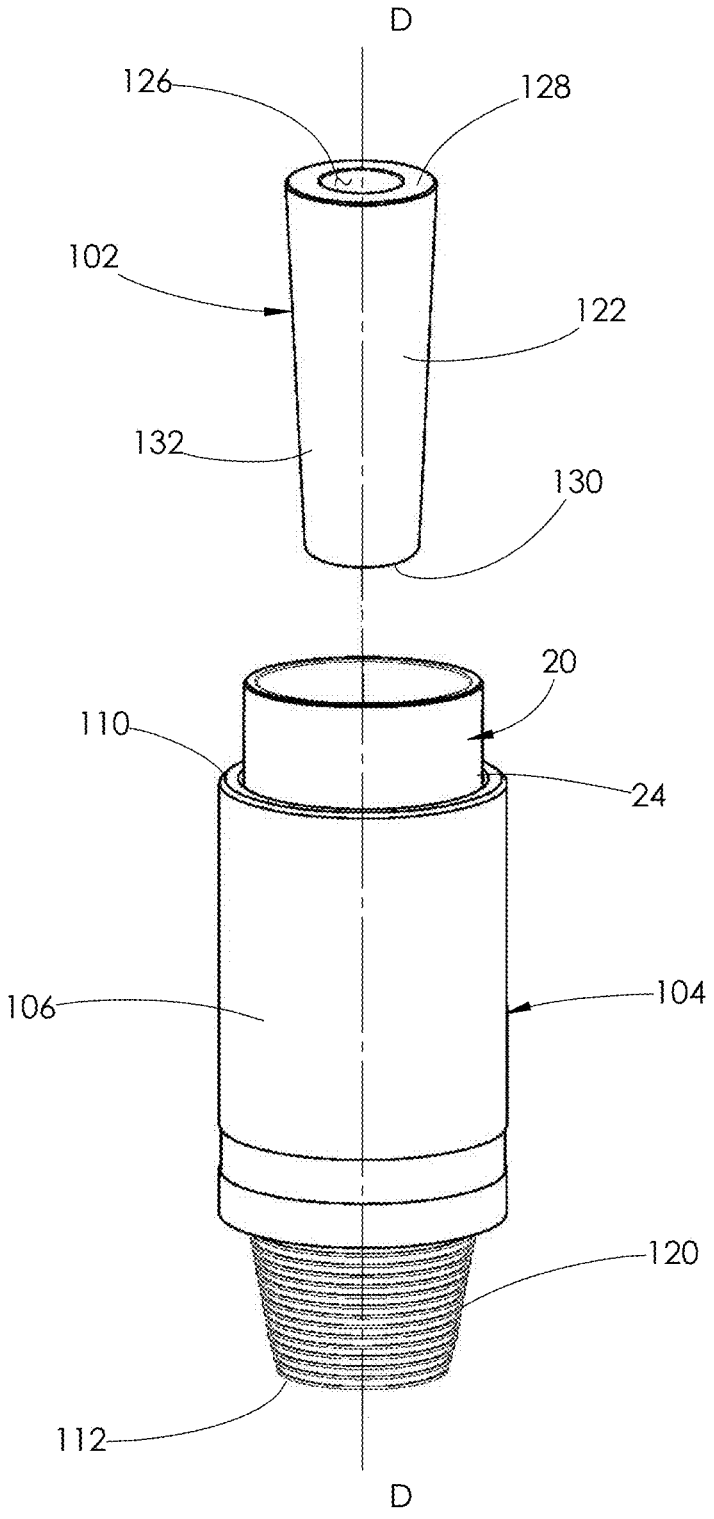
FIG. 6 is an exploded perspective view of the jar shown in FIG. 2.
Figure 7:
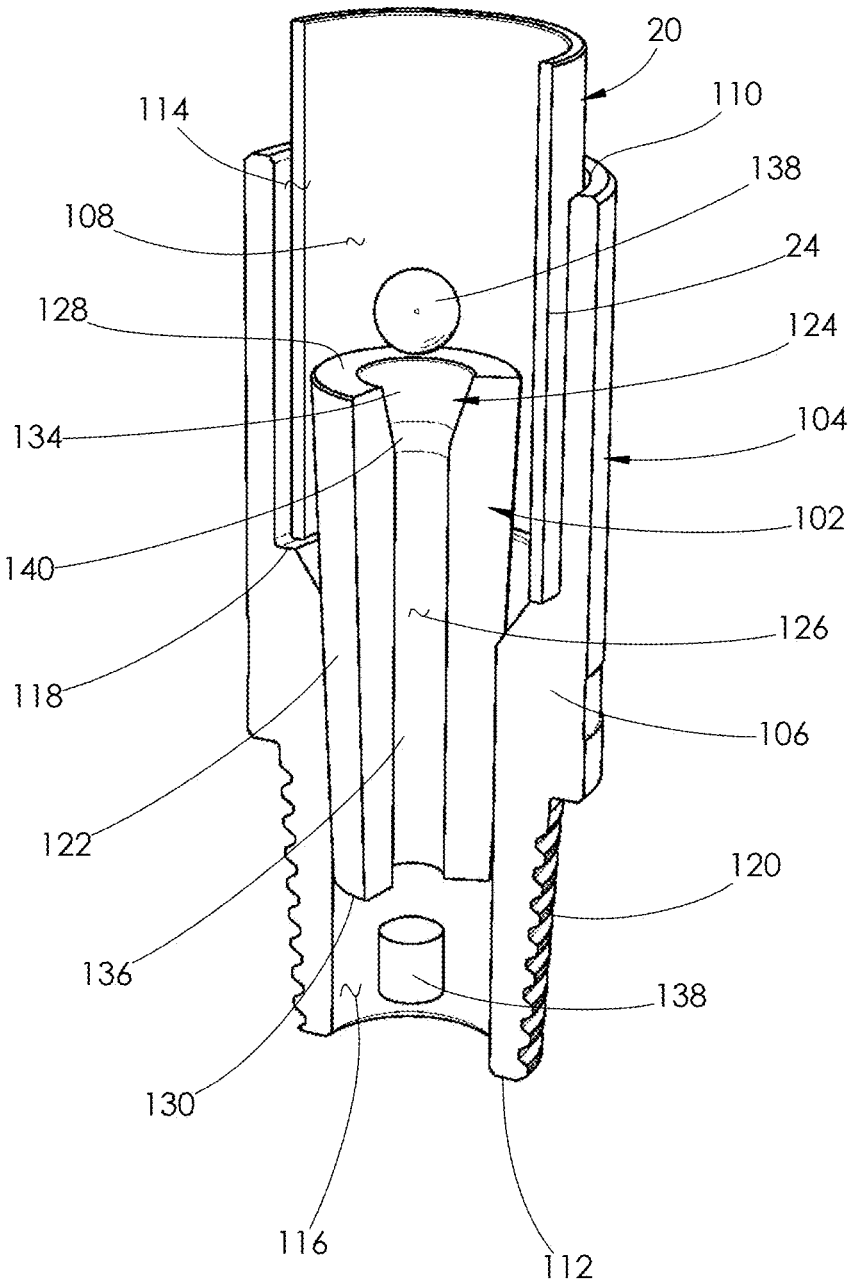
FIG. 7 is a perspective view of the jar shown in FIG. 6, in an assembled configuration. Portions of the funnel element and collar element have been cut away. An undeformed ball is shown above the funnel element and a deformed ball is shown below the funnel element.
Figure 8:
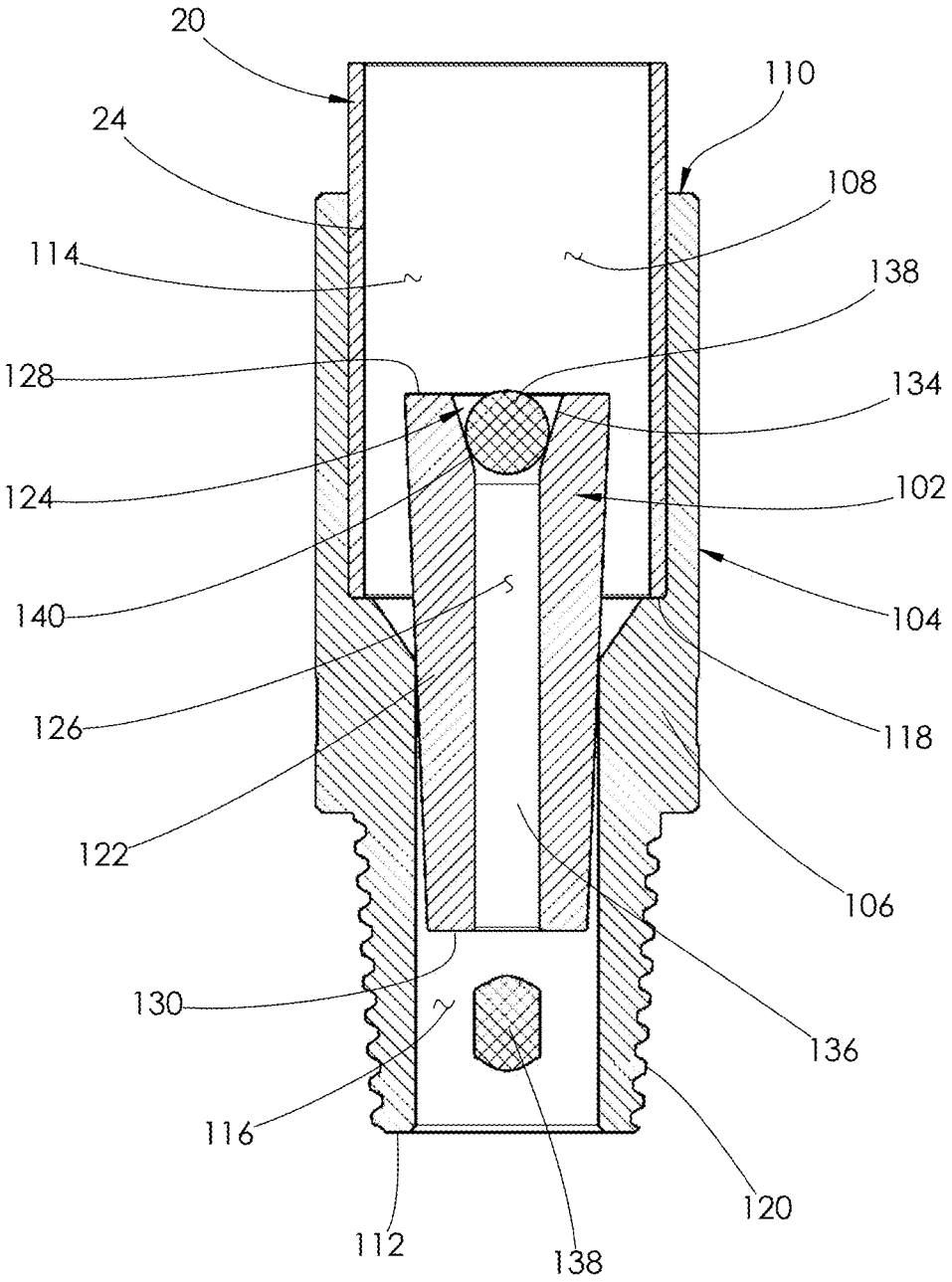
FIG. 8 is a cross-sectional view of the jar shown in FIG. 7. The cross-section is taken along a plane that includes the axis D-D shown in FIG. 6. An undeformed ball is shown seated within the funnel element and a deformed ball is shown below the funnel element.

Turning to FIGS. 2 and 6-8, the jar 100 comprises a funnel sub 102 that is installed within a collar element 104. The string 20 and the BHA 22 are attached to opposite ends of the collar element 104, as shown in FIG. 2. The collar element 104 has an elongate body 106 having a longitudinal internal passage 108 extending therethrough, as shown in FIGS. 7 and 8. The passage 108 opens at a first end 110 and an opposed second end 112 of the body 106. The passage 108 has an enlarged first portion 114 joined to a narrowed second portion 116. An annular shoulder 118 formed in the walls of the body 106 surrounding the passage 108 defines the boundary between the first and second portions 114 and 116. The passage 108 tapers inwardly below the annular shoulder 118 so that the second portion 116 is narrower than the first portion 114, as shown in FIGS. 7 and 8.

The first portion 114 of the passage 108 is configured to receive the first end 24 of the string 20. The first end 24 of the string 20 is inserted within the collar element 104 until it abuts the annular shoulder 118. The string 20 and collar element 104 may be joined by welds or slips. The collar element 104 is joined to the BHA 22 by a threaded connection. External threads 120, formed on the second end 112 of the collar element 104, mate with internal threads formed on the end of the BHA 22.

Continuing with FIGS. 6-8, the funnel sub 102 comprises an elongate body 122 having a funnel element 124 formed therein. The funnel element 124 is characterized by a longitudinal internal passage 126 that opens at a first surface 128 and an opposed second surface 130 of the funnel sub 102. An outer surface 132 of the funnel sub 102 is smooth and tapers inwardly from the first surface 128 to the second surface 130, as shown in FIG. 6. The outer surface 132 of the funnel sub 102 is configured to lodge into the second portion 116 of the passage 108 formed in the collar element 104, as shown in FIGS. 7 and 8.

The internal passage 126 of the funnel element 124 has an enlarged bowl 134 that tapers inwardly and connects with a narrow neck 136. A seat 140 is formed at the connection between the bowl 134 and the narrow neck 136. The bowl 134 opens at the first surface 128 of the funnel sub 102 and the narrow neck 136 opens at the second surface 130 of the funnel sub 102. The bowl 134 has the shape of a frustum of a right circular cone having a slant angle of between 15 and about 20 degrees. Preferably this angle is 17.5 degrees.

The collar element 104 is interposed between the string 20 and the BHA 22 prior to lowering the string 20 into the wellbore 10. The funnel sub 102 is held at the ground surface 12 while the string 20 is lowered downhole. If the string 20 or BHA 22 becomes stuck during operation, the jar 100 may be assembled.

To assemble the jar 100, the funnel sub 102 is inserted into the open second end 34 of the string 20 at the ground surface 12, shown in FIG. 1. Fluid pumped into the open second end 34 of the string 20 carries the funnel sub 102 through the string 20. The funnel sub 102 first travels through the above-ground second portion 30, at least part of which is wound upon the reel 32, and next travels underground within the first portion 28. The funnel sub 102 moves down the first portion 28 of the string 20 until it lodges within the collar element 104.

The assembled jar 100 is activated by lowering a deformable ball 138, shown in FIGS. 2, 7 and 8, into a seated position within the funnel element 124. The ball 138, in an undeformed state, is inserted into the open second end 34 of the string 20. Fluid carries the ball 138 through the string 20 until the ball 138 reaches the funnel sub 102. The ball 138 will engage the seat 140 formed in the funnel element 124 and block fluid from flowing through the funnel sub 102.

Fluid pressure is increased until the ball 138 deforms and is forced from the narrow neck 136 of the funnel element 124, as shown in FIGS. 7 and 8. The deformed ball 138 may be expelled through the funnel element 124 at a speed as high as 22,000-23,000 feet/second.

As the deformed ball 138 is expelled through the funnel sub 102, fluid within the string 20 and above the ball 138 will rapidly flow through the narrow neck 136 of the funnel element 124. This rapid release of fluid will cause a dynamic event within the wellbore 10. The dynamic event is characterized by a shock wave throughout the string 20 that causes a powerful jarring or jolting of the string 20 within the wellbore 10. The jarring or jolting of the string 20 works to dislodge the string 20 or BHA 22 from its stuck point within the wellbore 10.

If the first dynamic event does not dislodge the string 20 or BHA 22 from its stuck point, a second deformable ball 138 may be carried down the string 20 to the funnel element 124. Fluid pressure above the ball 138 is again increased until the ball 138 is deformed and forced through the narrow neck 136 of the funnel element 124. This process may be repeated as many times as needed until the string 20 is dislodged from its stuck point within the wellbore 10.

After each ball 138 is expelled through the funnel element 124, the balls may be retained within the BHA 22. A screen (not shown) may be incorporated into the BHA to retain the deformed balls but allow fluid to pass through. Alternatively, the deformed balls may pass through the bottom hole assembly and come to rest within the wellbore.

The balls 138 used to activate the jar 100 may have varying diameters. The greater the diameter of the ball 138, the greater the hydraulic pressure needed to deform the ball. The balls 138 are preferably solid and made of nylon, but can be made out of any material that is capable of deforming under hydraulic pressure and withstanding high temperatures within the wellbore 10.

The balls 138 may be porous and coated in a nano-particulate matter. Such a coating enhances frictional forces between the ball 138 and the funnel element 124. The greater the friction between the ball 138 and the funnel element 124, the greater hydraulic pressure required to extrude the ball 138 through the funnel element 124. Thus, the nano-particulate matter may help increase the speed at which the deformed balls 138 are extruded through the funnel element 124.

In operation, an operator in charge of activating the jar 100 is typically provided with a set of balls 138, each ball having a different diameter. The operator may start by sending a control ball down the string 20, thereby activating the jar 100. The operator may use any size ball 138 as a control ball. The control ball is used to gain information about the conditions within the wellbore 10. Such information is important because each wellbore may vary in depth, and the depth of the jar 100 within the wellbore at the time a tubular work string becomes stuck may vary. Due to these varying factors, the same size balls 138 may extrude at different pressures within each wellbore.

Once the control ball has been extruded through the funnel element 124 and the jarring event takes place, the operator may try to move the string 20 within the wellbore 10. Resulting movement of the string 20 may show that the control ball alone has caused the string 20 or BHA 22 to dislodge from the stuck point. If the string 20 does not move as desired, another ball 138 may be used to once again activate the jar 100. The size of this ball 128 may be chosen based on how much the string 20 moved, if at all, following the previous jarring cycle.

A pressure gauge at the surface 12 allows an operator to monitor the jarring process. Pressure builds within the string 20 until a ball 138 is extruded through the funnel element 124. After extrusion occurs, pressure within the string 20 drops precipitously. By noting the pressure drop points associated with balls 138 of different sizes, an operator can estimate what string pressure, and what size of ball 138, will be required for a particular jarring action.

The jar 100 may be made of steel, aluminum, plastic, carbon fiber or other materials suitable for use in oil and gas operations. Preferably the jar 100 is made of steel. The jar 100 may be coated with tungsten nitrate in order to harden its outer surface and reduce rusting.

The jar 100 may be assembled from a kit. Such a kit should include at least one funnel element 124 and at least one, and preferably a plurality of deformable balls 138. The kit may further include the collar element 104.

Figure 9:
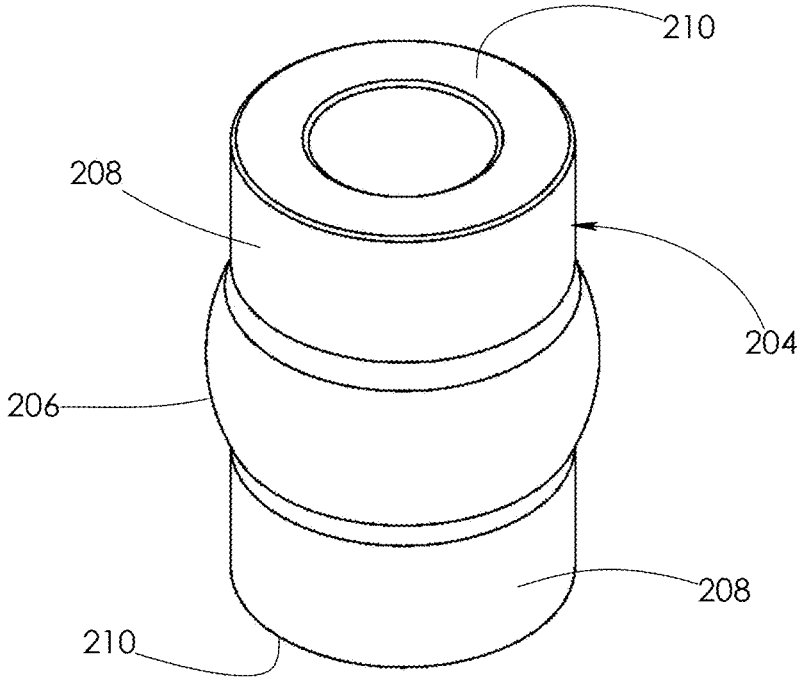
FIG. 9 is a perspective view of one of the plugs shown in FIG. 4.
Figure 10:
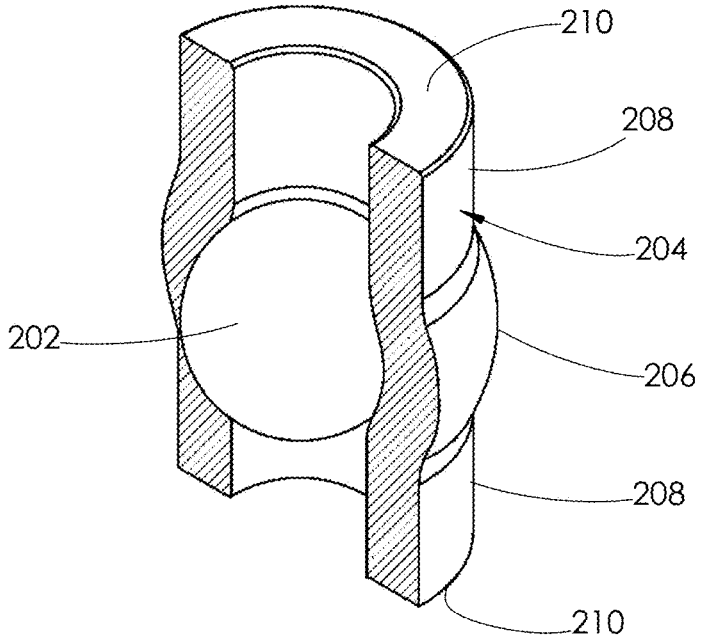
FIG. 10 shows the plug of FIG. 9 and its insert element. A portion of the sleeve has been cut away.
Figure 11:
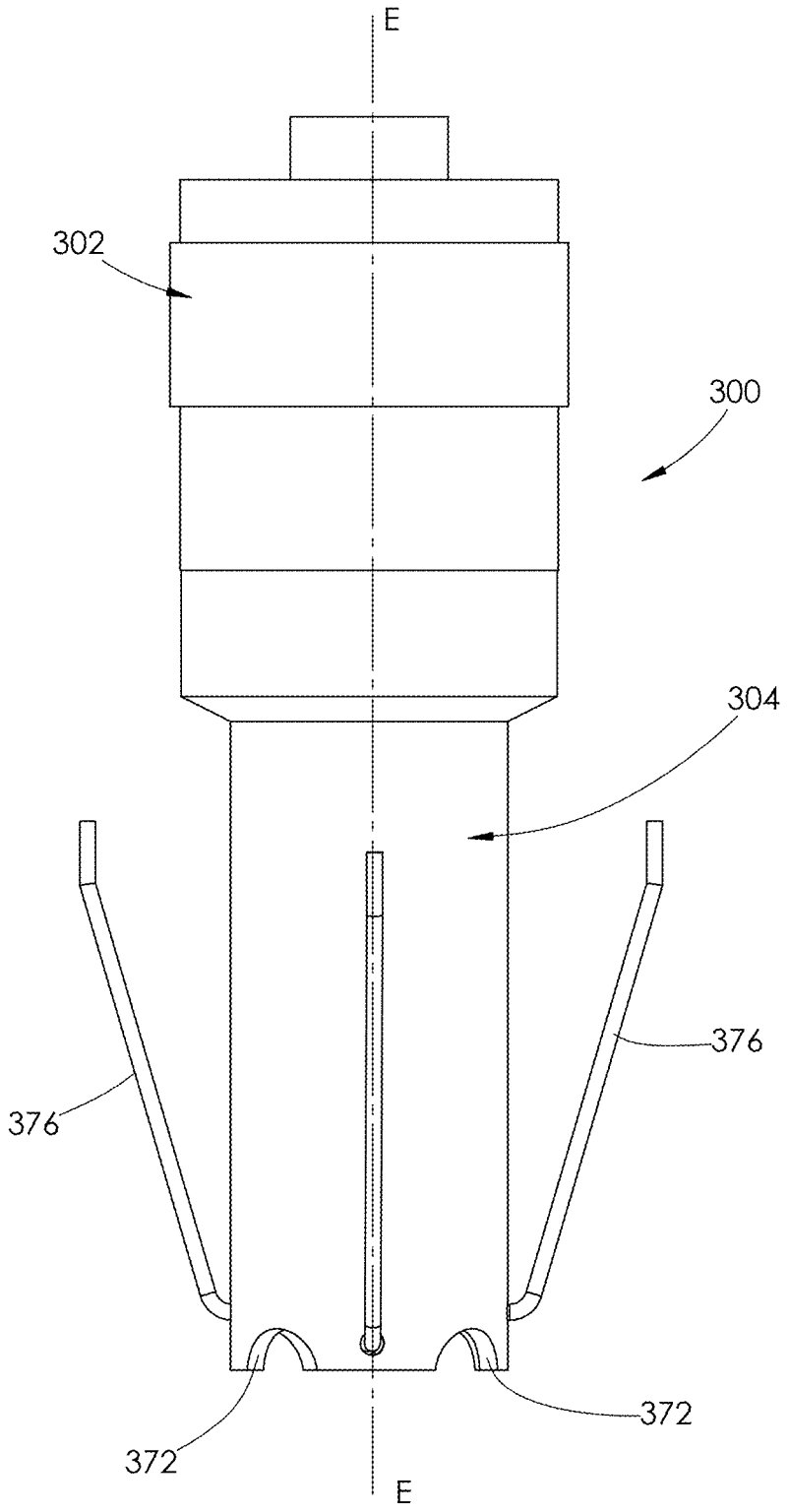
FIG. 11 is an enlarged front elevation view of the tubular severance device shown in FIG. 3.
Figure 12:
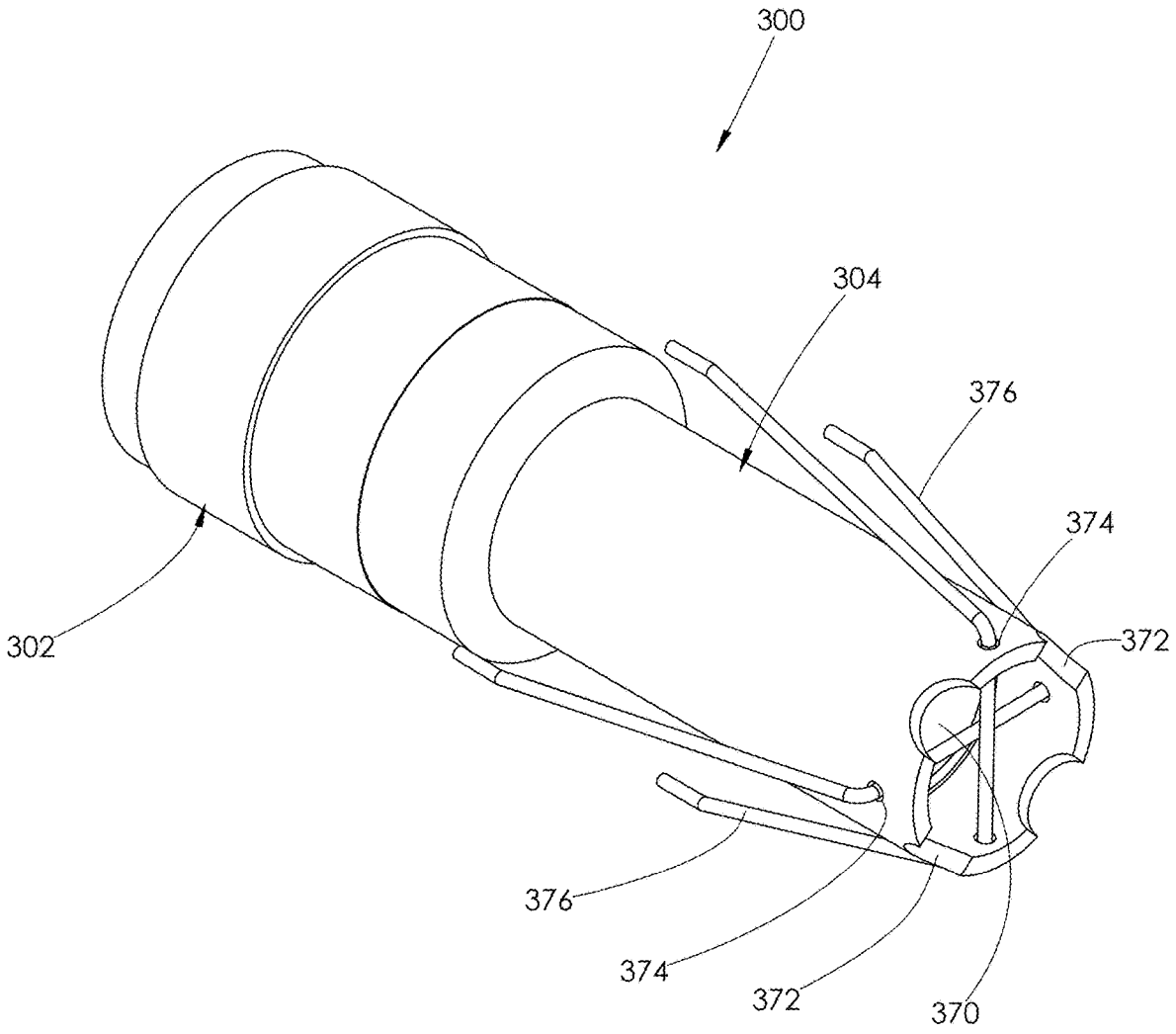
FIG. 12 is a perspective view of the device shown in FIG. 11.

Turning to FIGS. 9 and 10, each of the plugs 200 comprises an insert element 202 and a deformable sleeve 204. The insert element 202 is received and retained within a medial section 206 of the sleeve 204. The sleeve 204 has sections 208 joined to opposite sides of the medial section 206. Each section 208 has an open end 210. The medial section 206 has a larger maximum cross-sectional diameter than the sections 208 when the insert element 202 is installed within the sleeve 204. The plug 200 is sized to seal a single perforation 18 formed in the casing 14, as shown in FIG. 4.

The insert element 202 has the shape of a sphere and is preferably made of plastic, such as a thermoplastic or thermoset. However, the insert element 202 may be made of any material capable of withstanding high pressure. For example, the insert element 202 may be made of the same material as the sleeve 204. In some embodiments, the insert element 202 may be harder than the sleeve 204. The insert elements 202 may have a different shape than that disclosed herein, such as a shape having an oval or hexagonal profile. However, the insert element must be shaped such that it can seal a single perforation 18 when installed within the sleeve 204. The insert element 202 may be solid or hollow.

The sleeve 204 is preferably made of an elastic material, such as silicon, rubber, or neoprene. However, the sleeve 204 may be made out of any material that has elastic and viscous qualities such that it can block fluid from passing through a perforation 18. The plugs 200 may vary in size in accordance with the size of the perforations 18 formed in the casing 14.

As discussed above, plugging of the perforations 18 helps direct fluid towards the stuck point, where it can wash away debris. The plugs 200 may remain seated within the perforations 18 while the string 20 is being removed from the casing 14. If the string 20 extends within the perforated zone of the string 20, the seated plugs 200 serve as bearings that engage the string 20 and ease its removal from the casing 14.

Figure 13:
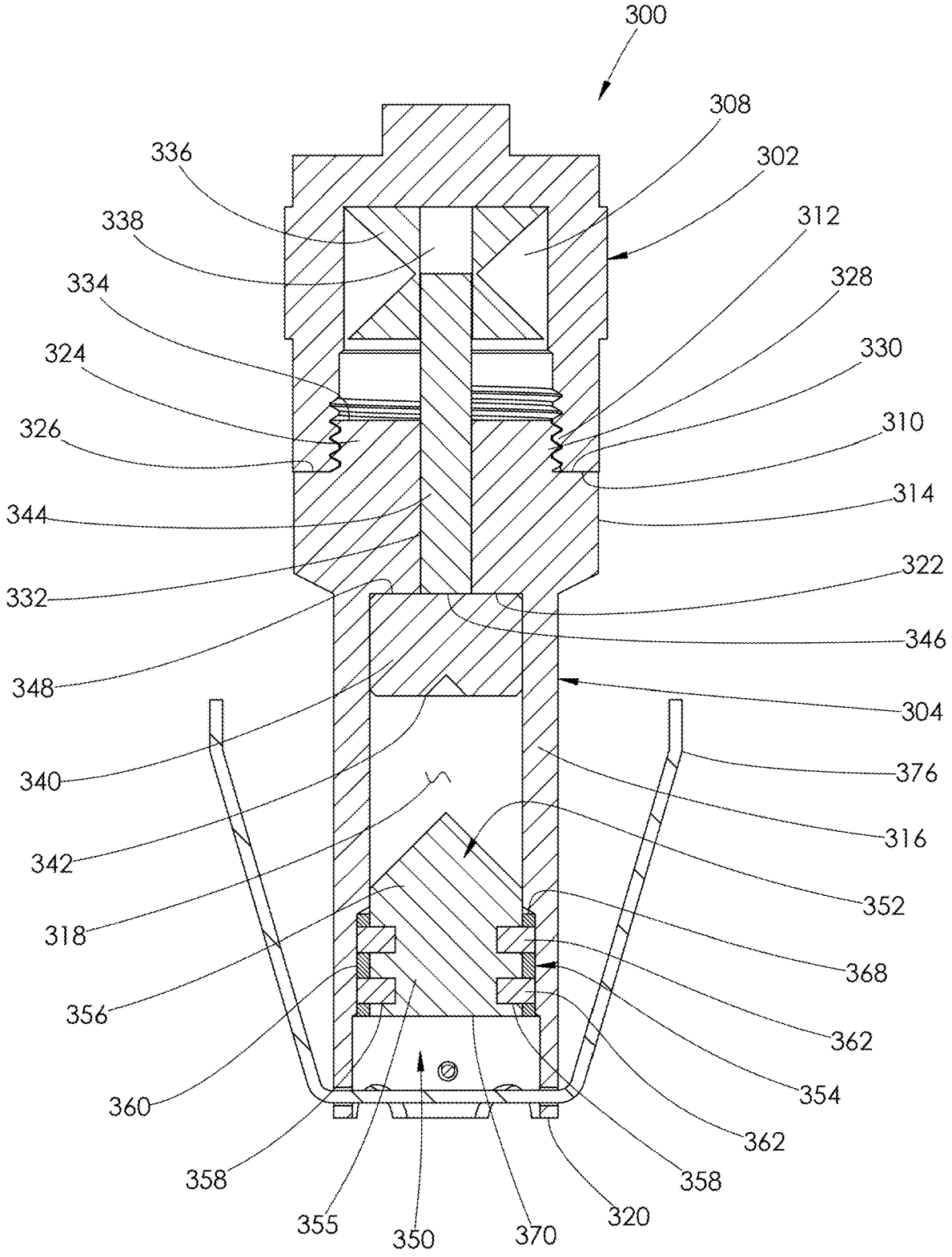
FIG. 13 is a cross-sectional view of the device shown in FIG. 11. The device is sectioned by a plane that extends through the axis E-E shown in FIG. 11.
Figure 14:
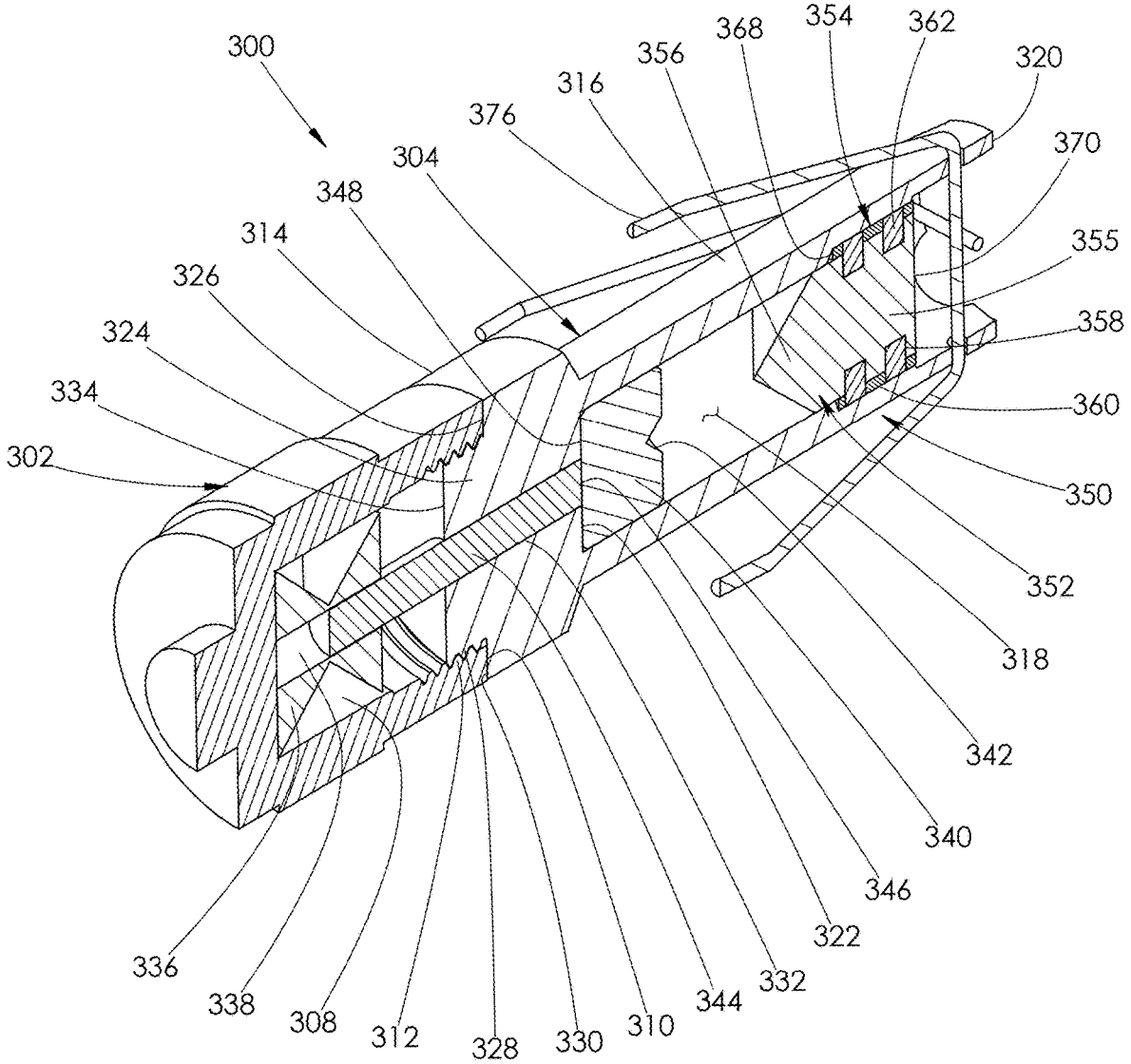
FIG. 14 is a perspective view of the device shown in FIG. 13.

Turning to FIGS. 3 and 11-16, the tubular severance device 300 comprises a first section 302 joined to a second section 304. A longitudinal axis E-E extends through each section 302 and 304. The sections 302 and 304 are preferably made of metal. The first section 302 has an internal bore 308 formed therein and extending longitudinally therethrough, as shown in FIGS. 13 and 14. The bore 308 opens at a bottom surface 310 of the first section 302. A series of internal threads 312 are formed in the walls of the bore 308 adjacent the bottom surface 310.

The second section 304 has an upper section 314 joined to a lower section 316. The upper section 314 has a maximum cross-sectional dimension that is larger than that of the lower section 316. An internal bore 318 is formed in the lower section 316. The bore 318 opens at a bottom surface 320 of the second section 304 and extends longitudinally through the lower section 316 until it reaches a face 322. The face 322 defines the boundary between the upper and lower sections 314 and 316 of the second section 304.

The upper section 314 includes a threaded portion 324 that projects from a top surface 326. A series of external threads 328 are formed on the threaded portion 324. The maximum cross-sectional dimension of the threaded portion 324 is less than that of the remainder of the upper section 314. An annular shoulder 330 joins the threaded portion 324 to the rest of the upper section 314. An internal passage 332 extends through the upper section 314 and interconnects the face 322 and a top surface 334 of the threaded portion 324.

The device 300 is assembled by mating the external threads 328 within the internal threads 312, thereby joining the first and second sections 302 and 304. When so assembled, the bottom surface 310 of the first section 302 abuts the annular shoulder 330 formed on the second section 304, as shown in FIGS. 13 and 14.

Continuing with FIGS. 13-16, an explosive charge 336 is placed within the internal bore 308 of the first section 302. The charge 336 is preferably a shaped charge. A central passage 338 is formed in the center of the charge 336. The passage 338 aligns with the passage 332 in the upper section 314 of the second section 304.

A detonator 340 is installed within the bore 318 formed in the second section 304, such that the detonator 340 abuts the face 322. The detonator 340 is cylindrical and has a thin outer housing that holds a dense flammable composite mixture. For example, the composite mixture may comprise titanium, potassium, and phosphorus mixed with glass. At the open bottom surface 342 of the detonator 340, the composite mixture is exposed to the environment.

An energy-transmitting cord 344 interconnects the charge 336 and the detonator 340. The cord 344 extends through the internal passage 332 and into the passage 338. A bottom surface 346 of the cord 344 abuts a top surface 348 of the detonator 340. The cord 344 may be in the form of a fuse comprising black powder wrapped in a tough textile or plastic.

A firing system 350 is configured to actuate the detonator 340, and comprises a firing pin 352 and a control system 354. The firing system 350 is housed in the second section 304, and more preferably within the internal bore 318 formed in the lower section 316.

Figure 15:
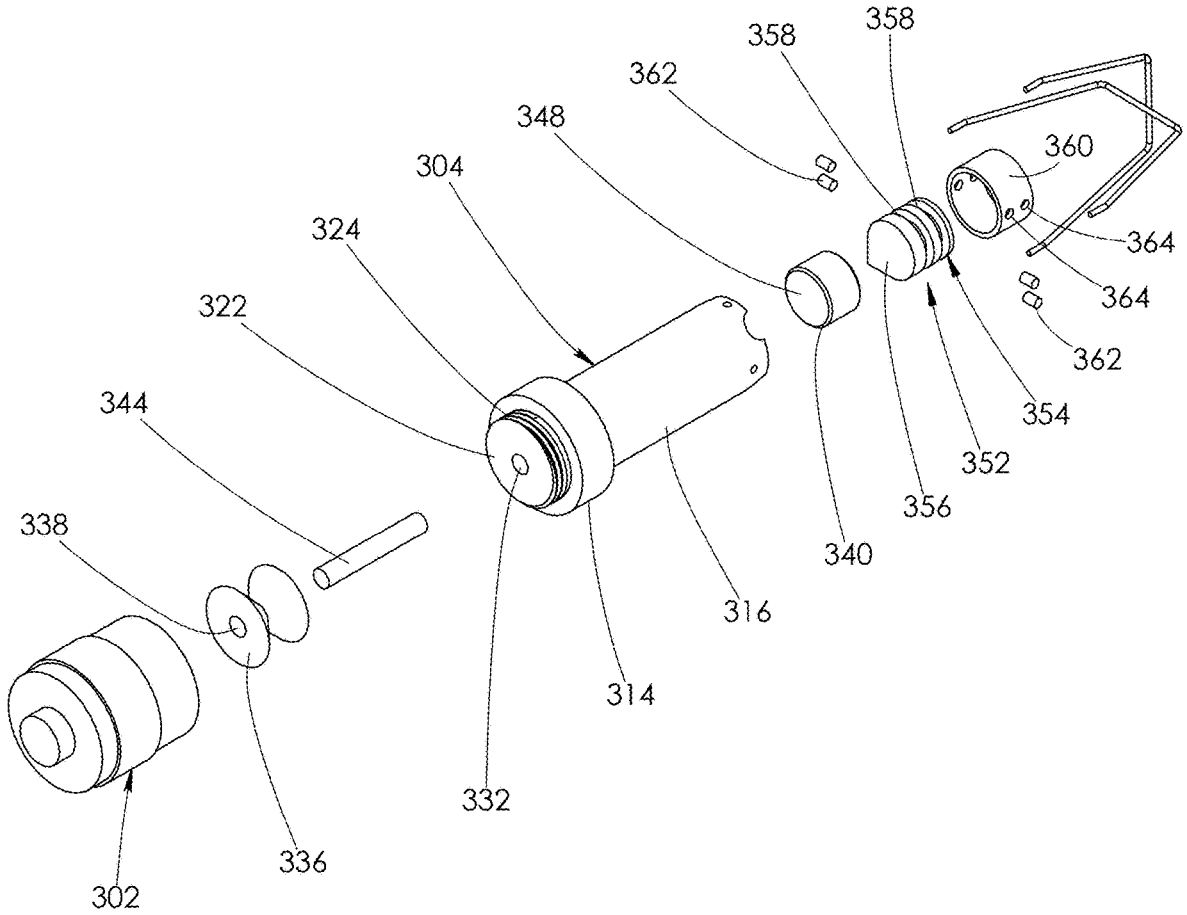
FIG. 15 is an exploded perspective view of the device shown in FIG. 11.

The firing pin 352, which is solid and preferably made of metal, features a cylindrical upper portion 355 that is joined to a cone-shaped lower portion 356. A plurality of annular grooves 358 are formed in the upper portion 354 of the firing pin 352, as shown in FIG. 15.

The control system 354 selectively maintains the firing pin 352 and the detonator 340 in an axially-spaced relationship. In addition, the control system 354 can selectively release one or both of the firing pin 352 and the detonator 340 from that axially-spaced relationship. The control system 354 comprises a collar 360 and a plurality of pins 362. The collar 360 is an annular ring that is preferably made of metal. The collar 360 has two pairs of diametrically opposed holes 364 formed in its periphery, as shown in FIG. 15. In alternative embodiments, the collar may have fewer than four holes or more than four holes formed in its periphery.

When the firing pin 352 is installed within the collar 360, the grooves 358 formed in the pin 352 align with the holes 364. The firing pin 352 and the collar 360 are held together by pins 362. Specifically, a pin 362 is inserted into each of the holes 364, such that the end of the pin engages the base of the underlying aligned groove 358. Once assembled, the firing pin 352 and collar 360 are installed within the bore 318. When installed, the collar 360 abuts an annular shoulder 368 formed in the inner walls surrounding the bore 318, as shown in FIGS. 13 and 14. The shoulder 368 prevents axial movement of the collar 360 within the bore 318.

The collar 360 is press fit into the walls surrounding the bore 318. In alternative embodiments, the collar may be threaded or welded into the walls surrounding the bore. When the control system 354 is installed within the second section 304 of the device 300, a bottom surface 370 of the firing pin 352 is exposed to the surrounding environment within the wellbore 10. When the control system 354 is installed within the second section 304, the space between the detonator 340 and the firing pin 352 is sealed and maintained at or around the surrounding atmospheric pressure.

Figure 16:
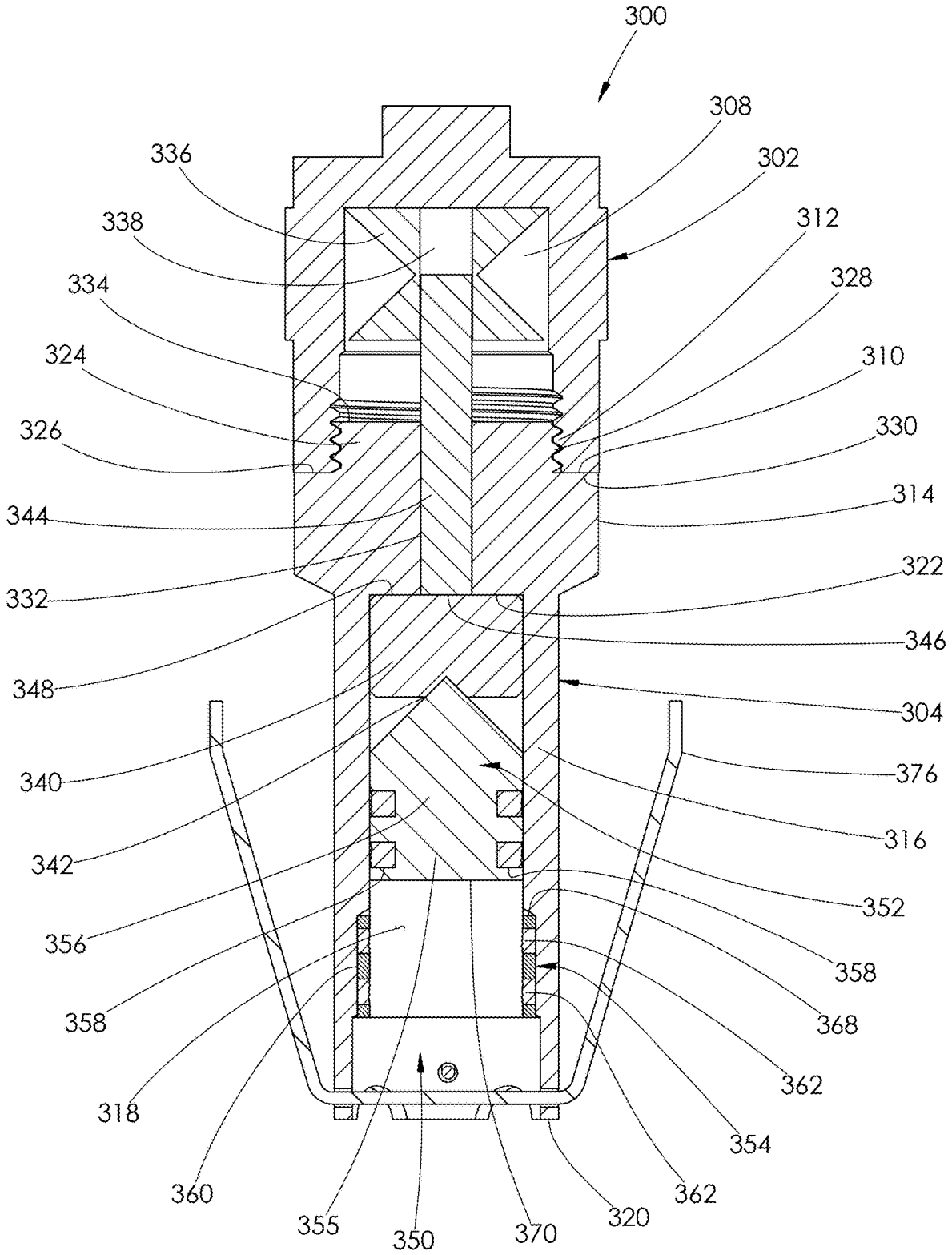
FIG. 16 shows the device of FIG. 13 after the firing pin has impacted the detonator.

With reference to FIG. 16, the control system 354 operates in response to fluid pressure within the string 20. Increased fluid pressure against the pins 362 causes them to shear, thereby releasing the firing pin 352 from the collar 360. After release, fluid pressure within the string 20 causes the firing pin 352 to move rapidly through the bore 318 and strike the detonator 340. The impact will cause the detonator 340 to ignite. Ignition of the detonator 340 ignites the cord 344, which in turn ignites the charge 336. The ignited charge 336 explodes and severs the surrounding tubular string 20, as shown in FIG. 5.

Figure 3:
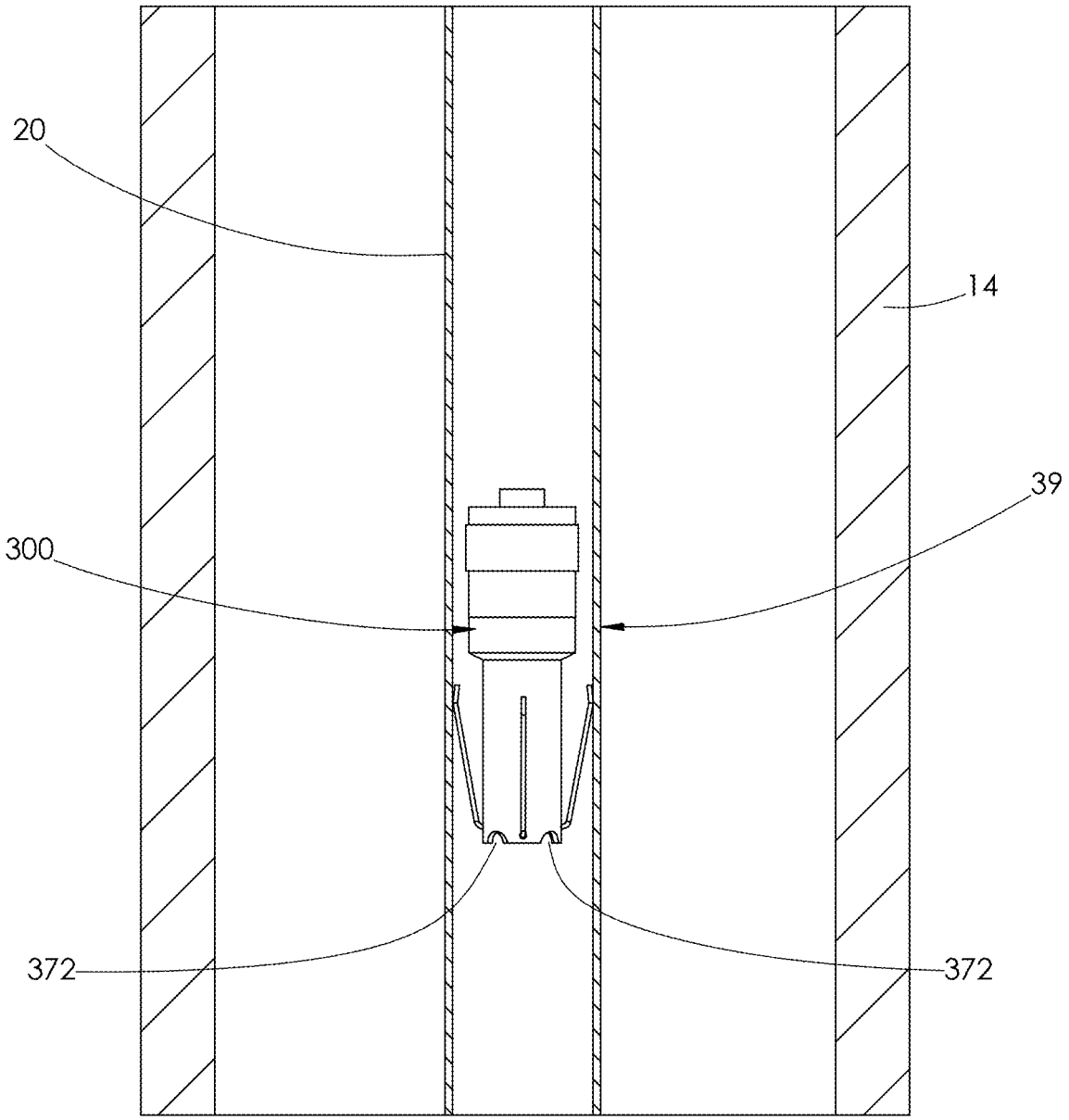
FIG. 3 is an enlarged view of area B from FIG. 1 and shows a tubular severance device. The tubular string is shown in cross-section.

Turning back to FIGS. 3, 11 and 12, a series of notches 372 are formed in the bottom surface 320 of the second section 304. The notches 372 provide side openings through which fluid may enter the device 300, even when its open base is clogged by debris. A wire or rod 376 may be threaded through a diametrically opposed pair of holes 374, such that the ends of the wire or rod 376 form a nonzero and acute angle relative to the lower section 316. Additional wires or rods 376 may be installed in other diametrically opposed pair of holes 374. The wires or rods 376 help center the device 300 within the string 20 as it is delivered to its desired position, as shown in FIG. 3.

Figure 17:
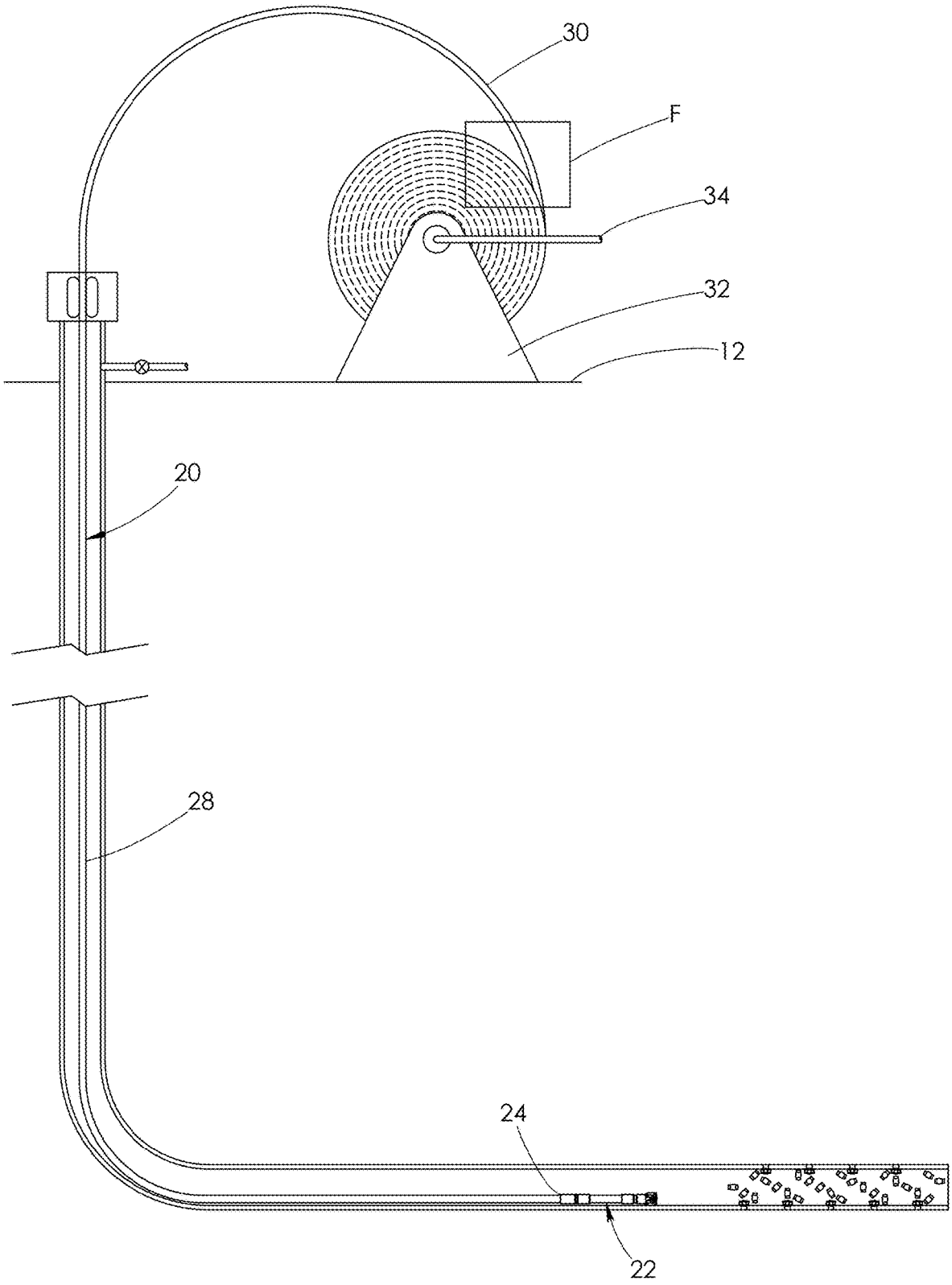
FIG. 17 shows the wellbore and pipe recovery system of FIG. 1 while the tubular severance device is above-ground.
Figure 18:
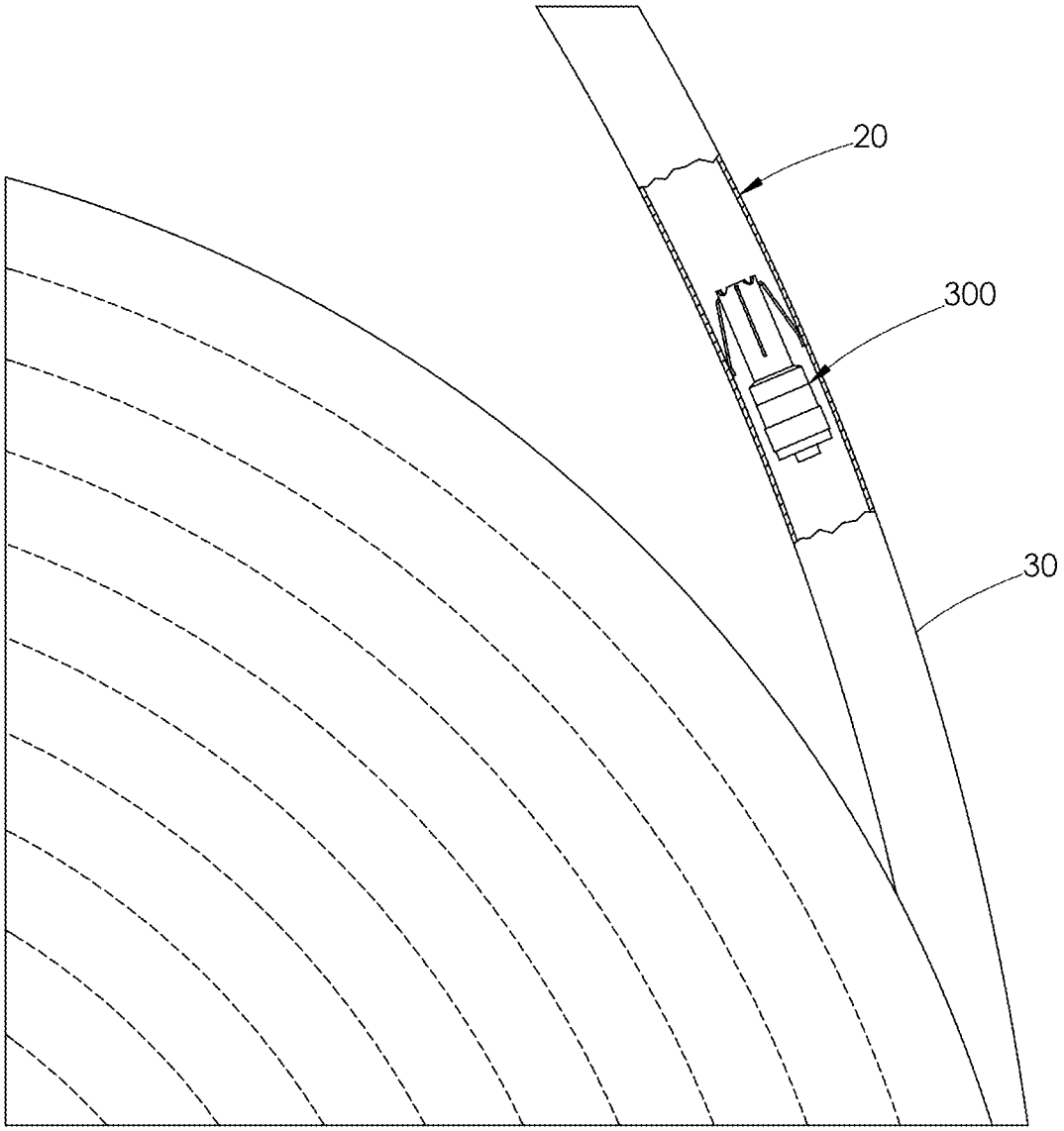
FIG. 18 is an enlarged view of area F shown in FIG. 17. A portion of the tubular string has been cut away in order to show an installed tubular severance device.
Figure 19:
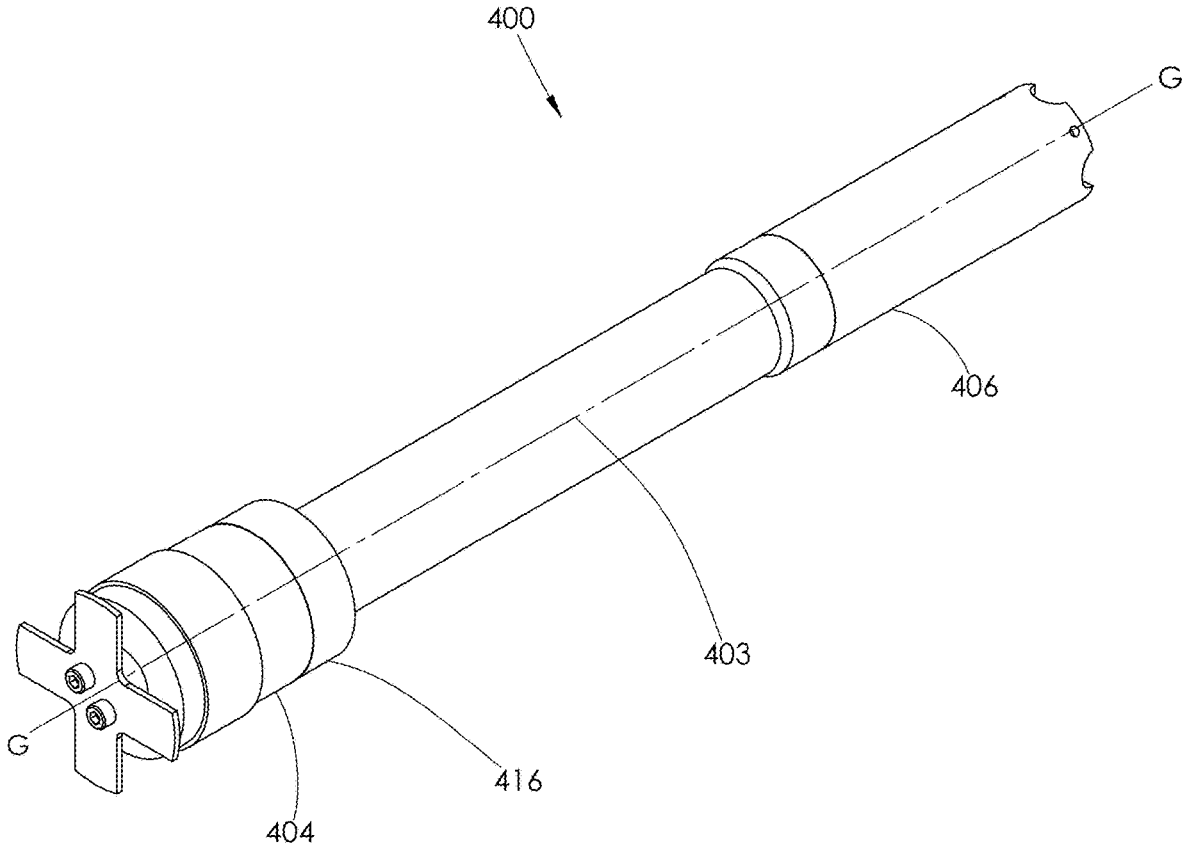
FIG. 19 is a perspective view of an alternative embodiment of a tubular severance device.

With reference to FIGS. 17 and 18, the device 300 is installed within the tubular string 20 by inserting the device 300, second section 304 first, through the open second end 34 of the string 20 at the ground surface 12. Fluid carries the device 300 through the second portion 30 of the string 20, shown in FIG. 18, and into the first portion 28 of the string 20, shown in FIGS. 1 and 3.

Turning back to FIGS. 1-3, the device 300 is positioned by shutting off fluid flow through the string 20, such as with the jar 100 and a ball 138. Fluid is then pumped into the string 20 and allowed to at least partially fill the string 20. The device 300 is lowered into the fluid within the string 20, and permitted to float at the desired point of severance.

For example, the string 20 within the wellbore 10 may be 1,000 feet long when measured from the ground surface 12 to the first end 24 of the string 20. The jar 100 may be positioned on the 1,000$^{th}$ foot of the string 20. The operator may want to sever the string 20 at 900 feet, allowing 900 feet of string 20 to be removed from the wellbore 10 and 100 feet of string 20 to be abandoned in the wellbore 10, as shown in FIG. 5.

In operation, the ball 138 is inserted into the open second end 34 of the string 20. Once fluid has carried the ball 138 100 feet through the string 20, the device 300 is inserted into the open second end 34 of the string 20. Pumping of fluid into the string 20 continues, and the ball 138 and device 300 are carried downward with the fluid. The 100-foot spacing between the ball 138 and the device 300 is maintained.

Pumping continues until the ball 138 seats within the funnel element 124 of the jar 100, thereby blocking fluid flow. Once pumping is stopped, the device 300 floats about 100 feet above the ball 138 and the funnel element 124. Thus, when the ball 138 seats within the jar 100 positioned at the 1,000$^{th}$ foot of the string 20, the device 300 is positioned at or near the 900$^{th}$ foot of the string 20.

Once the device 300 is at the desired severance position, fluid pressure within the wellbore 10 will be increased until the pins 362 are sheared. Once the pins 362 are sheared, the firing pin 352 is released and strikes the detonator 340. Detonation of the charge 336 will sever the string 20, as shown in FIG. 5. The remains of the device 300, together with the severed portion of the string 20, will be deposited in the wellbore 10.

Figure 20:
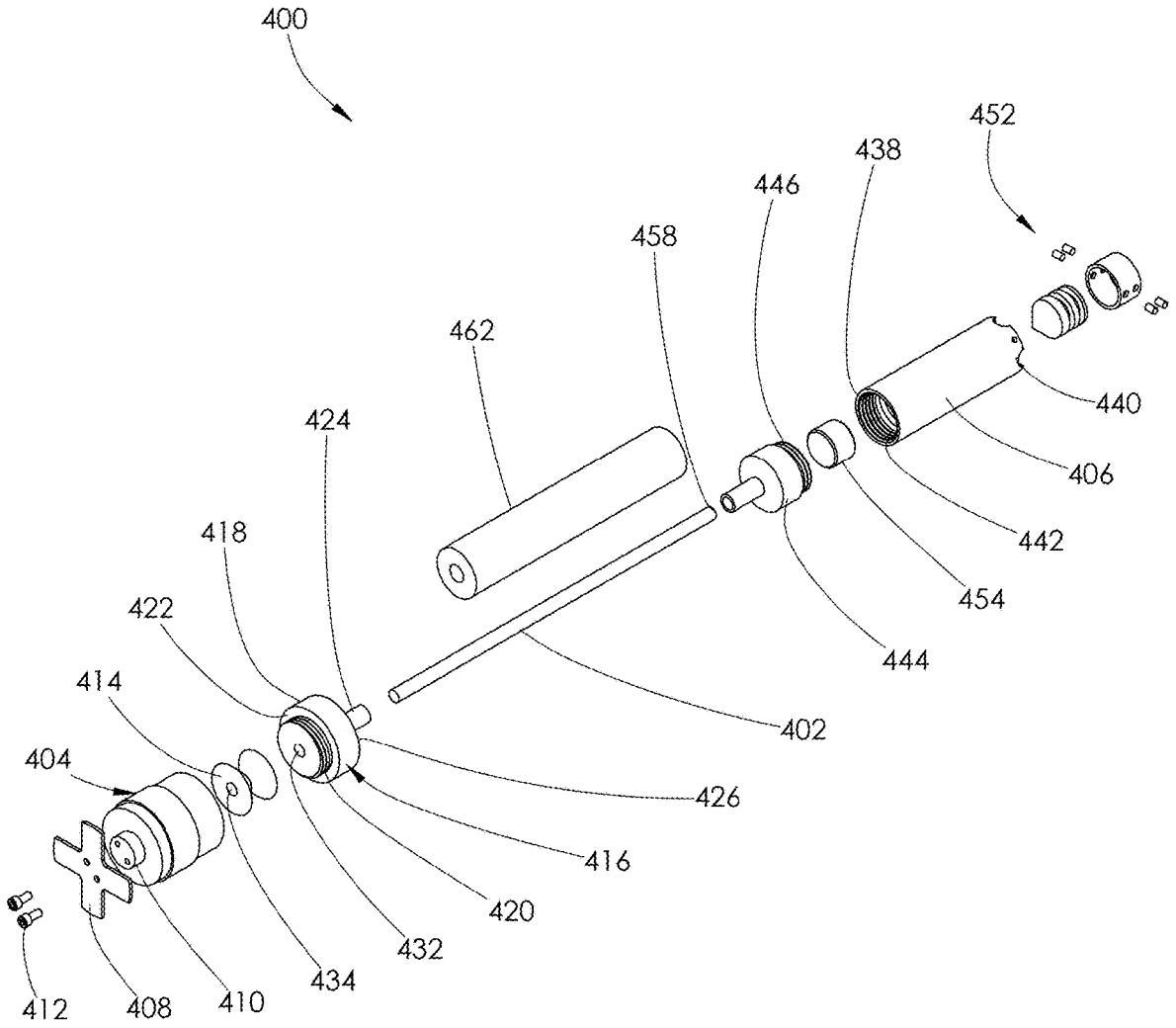
FIG. 20 is an exploded perspective view of the device shown in FIG. 19.
Figure 21:
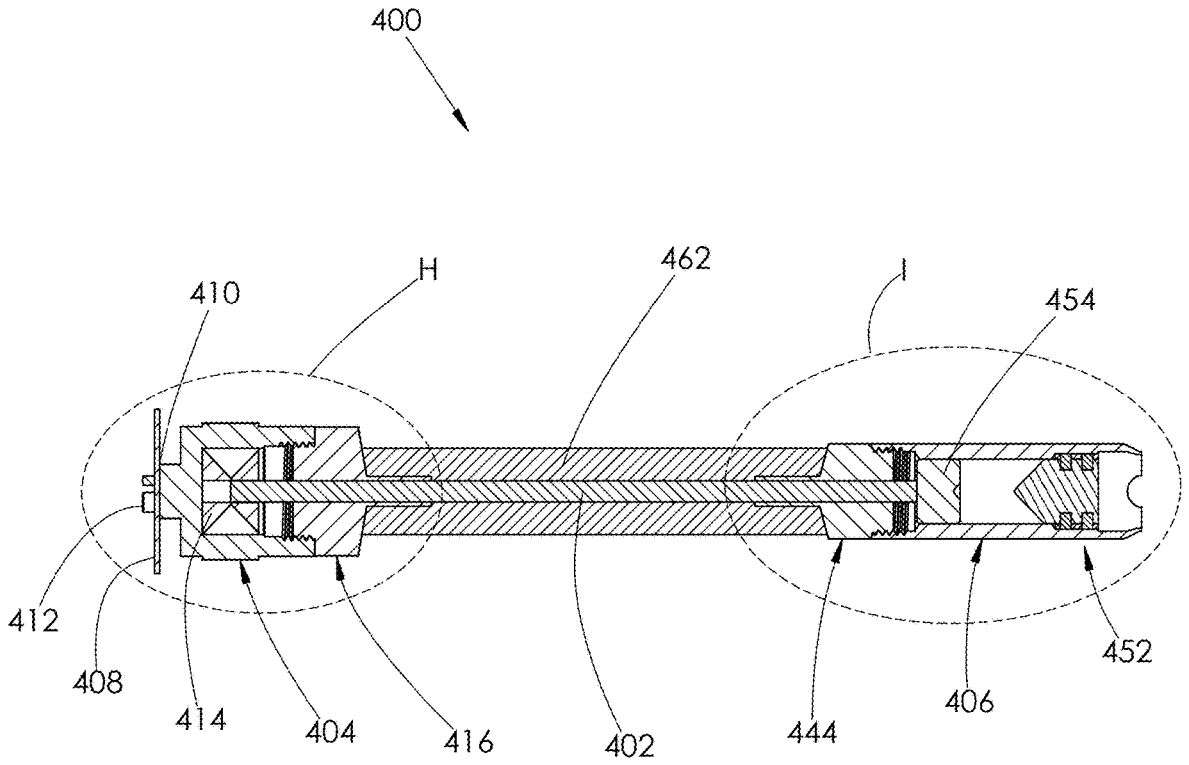
FIG. 21 is a cross-sectional view of the device shown in FIG. 19. The device is sectioned by a plane that extends through the axis G-G shown in FIG. 19.

Turning to FIGS. 19-23, an alternative embodiment of the tubular severance device 400 is shown. The device 400 is similar to the device 300, except that the device 400 uses a much longer cord 402, as shown in FIGS. 20 and 21. The device 400, which has a longitudinal axis G-G, comprises a first section 404, a second section 406, and a cord 402.

Figure 22:
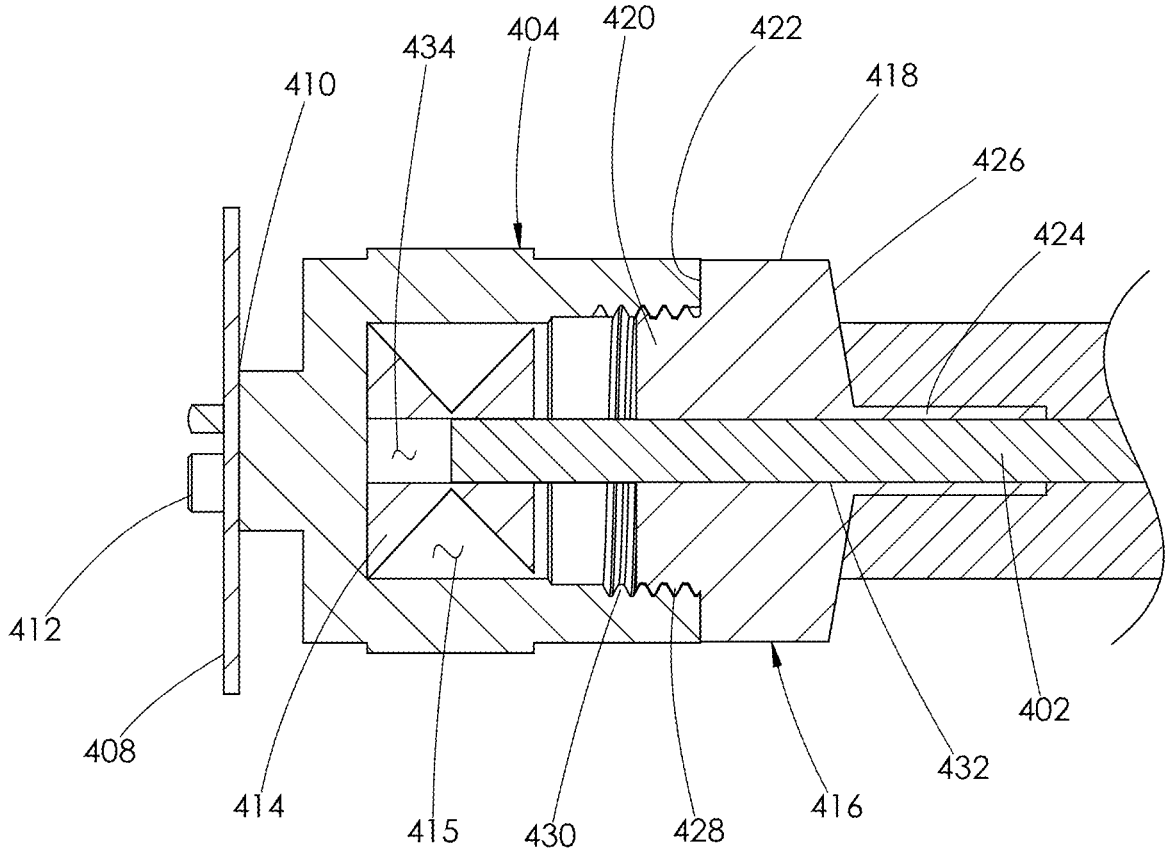
FIG. 22 is an enlarged view of area H shown in FIG. 21.

With reference to FIGS. 21 and 22, the first section 404 is identical to the first section 302 of the device 300, with one exception. In the device 400, a centralizer 408 is used to center the device with the string 20, rather than the rods 376 used in the device 300. The centralizer 408 is an X-shaped metal piece that engages the top surface 410 of the first section 404. The centralizer 408 is concentric with the first section 404, and attached to its top surface 410 with a pair of socket head screws 412. Like the first section 302, an explosive charge 414 is positioned within a bore 415 formed in the first section 404. The charge 414 is identical to the charge 336.

Unlike the device 300, the first and second sections 404 and 406 of the device 400 are not attached directly. Instead, each section 404 and 406 is joined to a cross-over sub 416 and 444 which is in turn joined to an end of the cord 402. The first cross-over sub 416, which is preferably formed from metal, is attached to the first section 404. The first cross-over sub 416 comprises a body 418 having a first end 424 and an opposed second end 426. Threads 420 are formed at the first end 422, and a tubular section 424 projects from the second end 426. An internal passage 432 extends through the sub 416. The passage 432 is aligned with a passage 434 formed in the charge 414. The passages 432 and 434 are configured to receive the cord 402.

Figure 23:
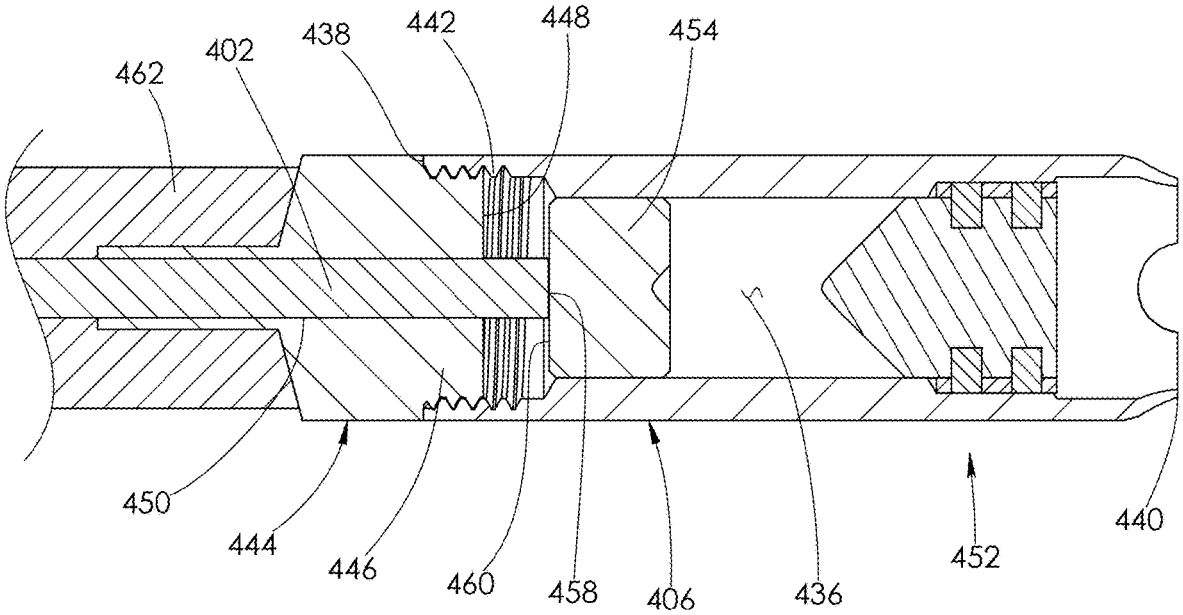
FIG. 23 is an enlarged view of area I shown in FIG. 21.

With reference to FIGS. 21 and 23, the second section 406 comprises a body, preferably formed from metal, having opposed top and bottom surfaces 438 and 440. An internal passage 436 extends longitudinally through the body and between the surfaces 438 and 440. Adjacent the top surface 438, internal threads 442 are formed in the walls defining the passage 436.

The second cross-over sub 444, which is preferably identical to the first cross-over sub 416, is attached to the second section 406. An externally threaded portion 446 of the sub 444 mates with the internal threads 442 of the second section 406. When mated, a bottom surface 448 of the sub 444 is exposed to the passage 436, as shown in FIG. 23. A passage 450 formed within the second cross-over sub 444 is configured to receive the cord 402.

A firing system 452 is positioned within the second section 406. The firing system 452 is identical to the firing system 350, described with reference to FIGS. 16-19. A detonator 454 included in the firing system 452 abuts the bottom surface 448 of the sub 444. When the cord 402 is installed within the passage 450 formed in the second cross-over sub 444, a bottom surface 458 of the cord 402 abuts a top surface 460 of the detonator 454.

When the device 400 is assembled, the cord 402 interconnects the detonator 454 and the charge 414. The cord 402 is made from the same material as the cord 344. The portion of the cord 402 that extends between the subs 416 and 444 is surrounded by a flexible seal 462. The seal 462 shown in the figures is a water-resistant tape formed from synthetic rubber. The tape is wrapped multiple times around the cord 402 so as to form a thick layer. In alternative embodiments, the seal may comprise any material that is flexible and water-resistant, such as rubber, nylon, or plastic. The seal 462 is preferably both flexible and water-resistant. It is flexible so that it may easily bend as the device 400 passes through the string 20 wound around the reel 32, shown in FIG. 21. It is water-resistant so that it can protect the cord 402 from fluid contained within the string 20.

In operation, the device 400 is delivered to the desired point of severance in the same manner as the device 300. The device 400 is likewise detonated in the same manner as the device 300.

In further alternative embodiments of the device 300 or 400, the cord may transfer energy electrically or hydraulically from the firing pin to the charge. In such embodiments, a detonator may not be used and the firing pin alone may be used to initiate the transfer of energy from the cord to the charge.

In further alternative embodiments of the device 300 or 400, the firing pin may be eliminated entirely. The detonator will be activated by an electronic circuit only. The electronic circuit may be battery powered or powered kinetically downhole. The electronic circuit may comprise a timer that is preset at the surface prior to inserting the device 300 or 400 in the open second end 34 of the string 20. The timer may be set to a time significantly larger than necessary to convey the device 300 or 400 to the desired point of severance providing a safety margin to be sure the device 300 or 400 is in the desired location. Once the set time has expired the electronic circuit will activate the detonator severing the string 20. It is also contemplated that only the explosive charge and electronic circuit be required to achieve detonation thus eliminating all other components previously required to achieve detonation including, but not limited to, the detonator, cord, and firing system. It is further contemplated that the electronic circuit of either of the above alternative embodiments may comprise a pressure sensor, and not a timer, that activates either the detonator or the charge once a preset activation pressure is obtained. It is further contemplated that the electronic circuit may comprise any necessary single, plurality, or combination of detection apparatus to be activated by any other physical characteristic measurable at the desired point of detonation including but not limited to, fluid flow rate, radial acceleration, linear acceleration, and physical orientation. It is further contemplated that the electronic circuit may be activated by any combination of a value or values of a single or plurality of physical characteristics measurable at the desired point of detonation.

When performing pipe recovery operations, an operator may first attempt to jar the string 20 using the jar 100. If jarring is unsuccessful, an operator may next try to flush away debris by pumping fluid into the annulus 40. Before this step can be carried out, plugs 200 are first deployed into the annulus 40 and seated in the perforations 18. Deployment of plugs 200 can occur either before or after jarring is complete. If fluid flushing is unsuccessful, an operator may next deploy one of the tubular severance devices 300 and 400. After the device 300 or 400 detonates, a portion of the first portion of the string 20 may be removed from the wellbore 10.

One or more kits may be useful for performing pipe recovering operations. The kits may comprise the jar 100, at least one deformable ball 138, a plurality of the plugs 200, and the tubular severance device 300 or 400.

Changes may be made in the construction, operation and arrangement of the various parts, elements, steps and procedures described herein without departing from the spirit and scope of the invention as described in the following claims.

The invention claimed is:

1. An apparatus, comprising:

a tubular severing device configured to be installed within a tubular string, the tubular severing device, comprising:

a first section having a first cavity formed therein;

a second section joined to the first section, the second section having a second cavity formed therein;

an explosive charge installed within the first cavity; and a control system engaging the explosive charge and configured to selectively initiate the explosive charge;

a sensor, configured to send a signal to the control system;

wherein the control system initiates the explosive charge in response to the signal; and wherein the first section is positioned upstream from the second section when the tubular severing device is installed within the tubular string.

2. The apparatus of claim 1, further comprising:

a detonator installed within the second cavity; and a detonation cord interconnecting the explosive charge and the detonator.

3. The apparatus of claim 1, wherein the sensor comprises:

a pressure sensor disposed within the tubular severing device, configured to provide a pressure signal to the control system;

wherein the control system is configured to initiate the explosive charge in response to the pressure signal meeting or exceeding a preset activation pressure.

4. An apparatus, comprising:

a tubular severing device configured to be installed within a tubular string, the tubular severing device, comprising:

a first section having a first cavity formed therein;

a second section joined to the first section, the second section having a second cavity formed therein;

an explosive charge installed within the first cavity; and a control system engaging the explosive charge and configured to selectively initiate the explosive charge;

a timer, in communication with the control system;

wherein the first section is positioned upstream from the second section when the tubular severing device is installed within the tubular string; and wherein the control system is configured to initiate the explosive charge in response to a signal from the timer.

5. The apparatus of claim 1 wherein the sensor sends the signal in response to a measured radial acceleration.

6. The apparatus of claim 1 wherein the sensor sends the signal in response to a measured linear acceleration.

7. The apparatus of claim 1 wherein the sensor sends the signal in response to a measured flow rate.

8. The apparatus of claim 1 wherein the sensor is configured to detect a plurality of measurements in a group consisting of:

fluid flow rate;

linear acceleration;

orientation; and pressure.

9. The apparatus of claim 8 in which the control system initiates the explosive charge in response to a combination of characteristics measured by the sensor.

10. The apparatus of claim 1, in which the first section is directly attached to the second section using threads.

11. A system comprising:

a wellbore formed within the ground and having a casing installed therein;

a tubular string having a first portion situated within the casing and a second portion wound around an above-ground reel; and the apparatus of claim 1 positioned within the second portion of the tubular string.

12. A system comprising:

a wellbore formed within the ground and having a casing installed therein;

a tubular string having a first portion situated within the casing and a second portion wound around an above-ground reel; and the apparatus of claim 1 positioned within the first portion of the tubular string.

13. A method of using a tubular string installed within a subterranean wellbore and having an above-ground open end, comprising:

inserting the apparatus of claim 1 into the open end of the tubular string such that the first section is positioned upstream from the second section;

causing fluid flow within the tubular string to carry the apparatus to an underground position within the tubular string; and causing fluid flow to suspend the tool at a desired point of severance within the tubular string.

14. The method of claim 13 further comprising:

triggering a detonation of the explosive charge with a pressure reading taken at the sensor.

15. The method of claim 13 further comprising:

triggering a detonation of the explosive charge with a firing pin striking a detonator.

* * * * *